US012336567B2

(12) United States Patent
Zhao

(10) Patent No.: US 12,336,567 B2
(45) Date of Patent: Jun. 24, 2025

(54) AEROSOL GENERATOR

(71) Applicant: Hexiang Zhao, Shanghai (CN)

(72) Inventor: Hexiang Zhao, Shanghai (CN)

(73) Assignee: Hexiang Zhao, Shanghai (CN)

( * ) Notice: Subject to any disclaimer, the term of this patent is extended or adjusted under 35 U.S.C. 154(b) by 458 days.

(21) Appl. No.: 17/981,418

(22) Filed: Nov. 5, 2022

(65) Prior Publication Data

US 2023/0217999 A1 Jul. 13, 2023

Related U.S. Application Data

(63) Continuation of application No. PCT/CN2021/092571, filed on May 10, 2021.

(30) Foreign Application Priority Data

May 5, 2020 (CN) ..... 202010370491.4
Aug. 28, 2020 (CN) ..... 202021836004.0

(51) Int. Cl.
*A24F 40/46* (2020.01)
*A24F 40/10* (2020.01)
*A24F 40/48* (2020.01)
*A24F 40/57* (2020.01)

(52) U.S. Cl.
CPC ..... *A24F 40/46* (2020.01); *A24F 40/10* (2020.01); *A24F 40/48* (2020.01); *A24F 40/57* (2020.01)

(58) Field of Classification Search
None
See application file for complete search history.

(56) References Cited

U.S. PATENT DOCUMENTS

2018/0160738 A1* 6/2018 Verleur ..... A24F 40/48
2019/0104766 A1† 4/2019 Tucker
2019/0174833 A1* 6/2019 Shuster ..... A24F 7/00

FOREIGN PATENT DOCUMENTS

CN 204146320 U † 2/2015
CN 109561734 A † 4/2019
CN 208692316 U † 4/2019
CN 110113959 A † 8/2019
CN 106072768 B † 12/2019
CN 209807152 U † 12/2019
CN 210203376 U † 3/2020
CN 210538902 U † 5/2020
CN 210782912 U † 6/2020
WO WO-2007098337 A2 * 8/2007 ..... A24F 47/008

* cited by examiner
† cited by third party

*Primary Examiner* — Cynthia Szewczyk
(74) *Attorney, Agent, or Firm* — IPRTOP LLC

(57) ABSTRACT

The present invention provides an aerosol generator, including an atomizing device, the aerosol generator further includes a gas-electric hybrid junction and a gas source device. The atomizing device is provided with an air passage located at the bottom of the atomizing device, the atomizing device is connected to a power supply through the gas-electric hybrid junction, and the gas source device is in communication with the air passage through the gas-electric hybrid junction and provides a cooling gas. The aerosol generator is modularized, miniaturized, and with a light weight, has the advantages of low power, low power consumption, and simple replacement and maintenance. Therefore, the problems of temperature control, oil leakage, and oil ejection are effectively solved.

28 Claims, 12 Drawing Sheets

AEROSOL GENERATOR

CROSS REFERENCE TO RELATED PATENT APPLICATION

This is a continuation application of a pending PCT application PCT/CN2021/092571-filed on May 10, 2021, which claims the priorities to a Chinese Patent Application No. CN202010370491.4 filed with CNIPA on May 5, 2020, and a Chinese Patent Application No. 202021836004.0 filed with CNIPA on Aug. 28, 2020, both applications are hereby incorporated by reference in their entireties, including any appendices or attachments thereof, for all purpose.

FIELD OF TECHNOLOGY

The present invention relates to the field of atomizing equipment, particularly to a modular aerosol generator.

BACKGROUND

Most of the existing aerosol generators utilize atomizing wires or heating tubes. After an atomizing agent flows to the atomizing wire or heating tube for heating, a high-temperature and high-pressure atomizing agent is formed. Then, the high-temperature and high-pressure atomizing agent is ejected from a nozzle to contact the atmospheric air under the action of pressure, and the atomizing agent is gasified to form aerosol due to a sudden pressure drop. This kind of equipment has the following defects: 1. The cooled atmospheric air contacts the high-temperature and high-pressure atomizing agent "outside the equipment" passively, therefore, an atomization process occurs in the area around the nozzle outside the equipment where there is full of high-temperature supersaturated steam, and a large number of high-temperature atomizing agent droplets with a kinetic energy that cannot be aerosolized is ejected, resulting in a great safety hazard; 2. Due to the high power and energy consumption, and the 220V alternating current and large-capacity battery-based power supply, the size of the equipment is large which makes it difficult to realize portable applications; 3. Instantaneous atomization cannot be achieved without preheating, because the heating tube needs to reach a certain temperature and needs to be heated continuously to ensure a normal operation of the equipment

SUMMARY

The present invention provides an aerosol generator with the characteristics of instantaneous atomization, normal temperature aerosol, convenient replacement, and small size.

The present invention adopts the following technical solutions:

An aerosol generator including an atomizing device is provided, and the aerosol generator further includes: a gas-electric hybrid junction and a gas source device, where the atomizing device is provided with an air passage located at the bottom of the atomizing device, the atomizing device is connected to a power supply through the gas-electric hybrid junction, and the gas source device is in communication with the air passage through the gas-electric hybrid junction and provides a cooling gas.

According to an aspect of the present invention, the atomizing device includes an upper frame, a liquid storage chamber, an atomizing member, and a lower frame, where the atomizing member is installed in the liquid storage chamber, and the atomizing member and the liquid storage chamber are hermetically fixed between the upper frame and the lower frame. The atomizing member includes an atomizing chamber, an atomizing wire, and an oil-guiding member that are located at a lower part of the atomizing member, and the air passage includes a cooling channel located at the bottom of the atomizing chamber and an atomizing outlet channel located at the top of the atomizing chamber, where the atomizing wire is located in the atomizing chamber and is fixed at the entrance of the atomizing outlet channel. The atomizing agent in the liquid storage chamber penetrates to the atomizing wire through the oil-guiding member for heating and vaporization, and the cooling gas is fed into the atomizing chamber through the cooling channel.

According to an aspect of the present invention, a liquid-guiding chamber arranged at a top of the lower frame is connected with the liquid storage chamber and located at the bottom of the liquid storage chamber, and a top of the cooling channel is higher than a top of the liquid-guiding chamber.

According to an aspect of the present invention, an outside at a bottom of the liquid-guiding chamber is an inverted cone-shaped or arc inclined plane-shaped, the atomizing wire is made of metal with good heat resistance, and a resistance value of the atomizing wire is in a range of 0.05-25 ohms. A middle part of the oil-guiding member is fixed in the atomizing wire, and the two ends of the oil-guiding member fill the bottom of the liquid-guiding chamber.

According to an aspect of the present invention, the atomizing wire is in the shape of a spiral, a tube, a mesh, or a sheet, and the oil-guiding member is made of a flexible fiber fabric material with good temperature resistance or a solid material with tiny voids.

According to an aspect of the present invention, a mounting hole is arranged in the middle of the lower frame, the gas-electric hybrid junction passes through the mounting hole and is hermetically connected to the lower frame, and the atomizing wire is connected to the power supply through the gas-electric hybrid junction.

According to an aspect of the present invention, an air passage is also arranged in the gas-electric hybrid junction, and the cooling gas is fed into the cooling channel through the gas-electric hybrid junction. The gas-electric hybrid junction includes a fixed joint and a movable joint, where the movable joint is connected to the fixed joint, and the fixed joint and the movable joint can turn on or off the positive and negative electrodes of the power supply and a gas source of the cooling gas.

According to an aspect of the present invention, the movable joint is connected to the fixed joint employing a thread, a buckle, an external force pressing, or a magnetic suction. The atomizing wire is located directly below the atomizing outlet channel, the cooling channel is located directly below the atomizing wire, and a top of the atomizing chamber on both sides of the atomizing outlet channel is designed to be arc-shaped, inverted cone-shaped, or cylindrical.

According to an aspect of the present invention, the movable joint includes a first insulating ring, a positive base, and a negative fixing head, where the positive base is fixed in the mounting hole, and the first insulating ring is located between the negative fixing head and the positive base. A positive end of the atomizing wire is connected with the positive base, and a negative end of the atomizing wire is connected with the negative fixing head. And the fixing joint includes a second insulating ring, a positive connecting seat, and a negative connecting head, where the second insulating ring is located between the positive connecting seat and the negative connecting head. When the fixed joint is connected with the movable joint, the air passage is in communication with the cooling channel, the atomizing wire is connected with the power supply through the movable joint and the fixed joint in sequence, the negative fixing head is arranged on the lower frame, the lower frame is fixed on the negative connecting head by the thread, the buckle, the external force pressing, or the magnetic suction, and the positive base is tightly attached to the positive connecting seat.

According to an aspect of the present invention, the aerosol generator further includes an installing seat installed at the bottom of the atomizing chamber and connected with an inner side of the atomizing member. The installing seat is provided with an oil-guiding hole, a positive connector, and a negative connector, where one end of the atomizing wire is connected with the positive base through the positive connector, and the other end of the atomizing wire is connected with the negative fixing head through the negative connector.

According to an aspect of the present invention, the aerosol generator further includes an outlet return element and an atomizing outlet nozzle, where the atomizing outlet nozzle is fixed on the upper frame, and the outlet return element is located in the atomizing outlet channel.

According to an aspect of the present invention, the aerosol generator further includes a top cover, an atomizing nozzle or/and an atomizing outlet tube, where the top cover is fixed on the upper frame, the atomizing outlet nozzle and the top cover are connected as a whole, and the atomizing outlet nozzle is connected with the atomizing nozzle or/and the atomizing outlet tube.

According to an aspect of the present invention, the aerosol generator further includes a gas-electric extension cable, where one end of the gas-electric extension cable is connected to the fixed joint, and the other end of the gas-electric extension cable is connected to the movable joint. The cooling gas is fed into the atomizing chamber through the air passage, the gas-electric extension cable, the gas-electric hybrid junction, and the cooling channel in sequence, and the atomizing wire is connected to the power supply through the movable joint, the gas-electric extension cable, and the fixed joint in sequence.

According to an aspect of the present invention, the gas-electric extension cable includes two or more wires, an inlet tube, and an outlet tube, where the atomizing wire is connected to the power supply through the movable joint, the two or more wires, and the fixed joint in sequence. The insides of the inlet tube and the outlet tube are both provided with vent holes, where the vent holes are connected with the air passage, the inlet tube is connected with the fixed joint, and the outlet tube is connected with the movable joint.

According to an aspect of the present invention, the aerosol generator is provided with a plurality of the atomizing devices, the gas-electric extension cable is provided with one inlet tube and a plurality of outlet tubes, and the gas-electric hybrid junction is provided with one fixed joint and a plurality of movable joints, where the fixed joint is connected to the inlet tube, the plurality of outlet tubes are connected to the inlet tube, and each outlet tube is connected to a corresponding atomizing device.

According to an aspect of the present invention, the cooling gas is selected from air, inert gas, and carbon dioxide, and the pressure of the cooling gas is in a range of 0.002-0.7 MPa. The resistance value of two wires is 1-200 ohm/km, and the diameter of the wires is in a range of 0.2-10 mm.

According to an aspect of the present invention, the aerosol generator further comprises a gas pump and a cooling gas nozzle, where an outlet of the gas pump is in communication with the air passage, the cooling gas nozzle is located in the air passage which is capable of changing the aperture or/and structure of the air passage, and a voltage of the gas pump is adjustable.

According to an aspect of the invention, the aerosol generator is provided with a power control device connected to the power supply, where the power control device can regulate the operating voltage of the atomizing wire.

According to an aspect of the present invention, after the atomizing agent forms an aerosol, the particle size and the concentration of the aerosol can be adjusted by controlling the velocity of the cooling gas, and the temperature of the aerosol can be adjusted by controlling the heating power of the atomizing wire, the heat dissipation power of the cooling gas, and the viscosity of the atomizing agent.

According to an aspect of the present invention, the atomizing device includes the atomizing member, the upper frame, the liquid storage chamber, and the lower frame, where the atomizing member is located in the liquid storage chamber, the atomizing member and the liquid storage chamber are hermetically fixed between the upper frame and the lower frame. The air passage and a heating member are arranged in the atomizing member, and a liquid-guiding hole is set on a side of the atomizing member, where the heating member is located around the air passage, and the atomizing agent in the liquid storage chamber penetrates to the heating member through the liquid-guiding hole for heating and vaporization. The upper frame is provided with an atomizing outlet hole, where the gas-electric hybrid junction and the atomizing outlet hole are respectively in communication with the air passage, and the gas source device sends the cooling gas to the air passage through the gas-electric hybrid junction.

According to an aspect of the present invention, the aerosol generator further includes an outlet return element, an atomizing outlet nozzle, an atomizing nozzle or/and an atomizing outlet tube, where the atomizing outlet nozzle is fixed on the upper frame, the outlet return element is located in the air passage, and the atomizing outlet nozzle is connected with the atomizing nozzle or/and the atomizing outlet tube. The atomizing member further includes an atomizing core and a rack, where the two ends of the rack are hermetically connected with the upper frame and the lower frame respectively; the air passage is located in the rack, the atomizing core is fixed under the rack, the heating member is fixed in the atomizing core, and the liquid-guiding hole is located outside the atomizing core. The atomizing device is further provided with a shell hermetically connected with the upper frame and the lower frame respectively, where the liquid storage chamber is formed by the surround of an inner wall of the shell and the outer walls of the upper frame, the lower frame, and the rack.

According to an aspect of the present invention, the power of the atomizing device is in a range of 5-200 W. The cooling gas is selected from air, inert gas, and carbon dioxide, and the pressure of the cooling gas provided by the gas source device is in a range of 0.002-0.7 MPa. After the atomizing agent forms the aerosol, the particle size and the concentration of the aerosol can be adjusted by controlling the velocity of the cooling gas, and the temperature of the aerosol can be adjusted by controlling the heating power of the atomizing wire, the heat dissipation power of the cooling gas, and the viscosity of the atomizing agent.

According to an aspect of the present invention, the aerosol generator is further provided with a gas tube, and the air passage is provided in the middle of the gas-electric hybrid junction, where one end of the gas tube is connected to the gas source device, and the other end of the gas tube is connected to the air passage. The heating member is connected to the power supply through the gas-electric hybrid junction, and a mounting hole is arranged in the middle of the lower frame made of a conductive material. The gas-electric hybrid junction includes a fixed joint and a movable joint, where the fixed joint includes a first insulating ring, a positive base, and a negative fixing head, the positive base is fixed in the mounting hole, a lower end of the rack is fixed on the positive base, and the first insulating ring is located between the negative fixing head and the positive base. The positive electrode of the heating member is tightly attached to the positive base through an outer side of the first insulating ring, and the negative electrode of the heating member is tightly attached to the negative fixing head through an inner side of the first insulating ring. The movable joint includes a second insulating ring, a positive connecting seat, and a negative connecting head, where the second insulating ring is located between the positive connecting seat and the negative connecting head. When the fixed joint is connected with the movable joint, the positive connecting seat is fixed below the lower frame, the negative connecting head is tightly attached to the negative fixing head.

According to an aspect of the present invention, the aperture of the air passage at the connection of the negative fixing head and the atomizing core is smaller than the aperture of the air passage in the atomizing core, so that the pressure of the air passage in the atomizing core is smaller than the pressure in the liquid storage chamber.

According to an aspect of the present invention, the aerosol generator further includes a gas-electric extension cable, where one end of the gas-electric extension cable is connected to the fixed joint, and the other end of the gas-electric extension cable is connected to the movable joint. The cooling gas is fed into the atomizing core through the air passage, the fixed joint, the gas-electric extension cable, and the movable joint in sequence, and the heating member is connected to the power supply through the movable joint, the gas-electric extension cable, and the fixed joint in sequence.

The advantages of the present invention are as follows:

The modular aerosol generator of the present invention includes the atomizing device, the gas-electric hybrid junction, and the gas source device, where the atomizing device is provided with an air passage and connected to the power supply through the gas-electric hybrid junction, and the gas source device provides the cooling gas and communicates with the air passage through the gas-electric hybrid junction. The atomizing device typically includes the atomizing member, the upper frame, the liquid storage chamber, and the lower frame, where the atomizing member is located in the liquid storage chamber, and the atomizing member and the liquid storage chamber are hermetically fixed between the upper frame and the lower frame which prevents the atomizing agent from leaking out of the liquid storage chamber. The atomizing member is provided with the atomizing wire or the heating member. And the air passage is located at the bottom of the atomizing device. The cooling gas flowing from the air passage located at the bottom to the atomizing chamber can perform a sudden cooling on the atomizing agent heated to a supersaturated state on the surface of the atomizing wire or the heating member to form the aerosol quickly, where the atomizing agent is heated by the atomizing wire or the heating member and in a steam state, then the formed aerosol is blown out of the aerosol generator. As a result, the aerosol with a good atomization effect is formed from the atomizing agent through the "liquid-gas-liquid" physical change in the aerosol generator. Meanwhile, the atomizing agent in the liquid storage chamber continuously penetrates to the atomizing wire or the heating member and continuously repeats the "liquid-gas-liquid" atomization process. Therefore, the atomizing device of the present invention can provide an aerosol with normal temperature and fine particle size sustainably and instantaneously, does not need to be preheated, can work under the power range of 5-200 W, and can be directly driven by a small-capacity lithium battery, resulting in meeting the requirements of different scenarios. In addition, the cooling gas is generally selected from air, inert gas, and carbon dioxide (other types of gases can also be used). Since the cooling gas is sent into the atomizing chamber to quickly cool the atomizing agent in the high-temperature steam state to form an aerosol with normal temperature and good atomization effect, the risk of burns is prevented and the use safety is ensured for users and other persons.

The aerosol generator of the present invention is further provided with the gas-electric hybrid junction, where the atomizing device is connected to the power supply through the gas-electric hybrid junction, the air passage is arranged in the gas-electric hybrid junction, and the gas source device is connected to the air passage through the gas-electric hybrid junction, so that the cooling gas can be sent to the air passage in the atomizing device through the gas-electric hybrid junction, which realizes the independent supply of the voltage and pressure of the aerosol generator and results in the aerosol generator with a compact structure, small volume, and convenient replacement.

BRIEF DESCRIPTION OF THE DRAWINGS

To better illustrate the technical solutions of the embodiments of the present invention, the following will briefly introduce the drawings required for embodiment description. Obviously, the drawings in the following description are merely some embodiments of the present invention. For those of ordinary skill in the art, other drawings may be obtained based on these drawings without creative efforts.

DETAILED DESCRIPTION

The technical solutions in the embodiments of the present invention will be described clearly and completely below with reference to the drawings. The described embodiments are only a part of the embodiments of the present invention, instead of all embodiments of the present invention. All other embodiments that persons of ordinary skill in the art obtain without creative efforts based on the embodiments of the present invention also fall within the scope of the present invention.

Embodiment 1

As shown in FIGS. 1-6 and 14, an aerosol generator is provided, which includes an atomizing device. The aerosol generator further includes a gas-electric hybrid junction 9 and a gas source device 12. The atomizing device is provided with an air passage 21 located at a bottom of the atomizing device. The atomizing device is connected to a power supply via the gas-electric hybrid junction 9, and the gas source device 12 is connected with the air passage 21 via the gas-electric hybrid junction 9. The gas source device 12 provides cooling gas.

Figure 14:
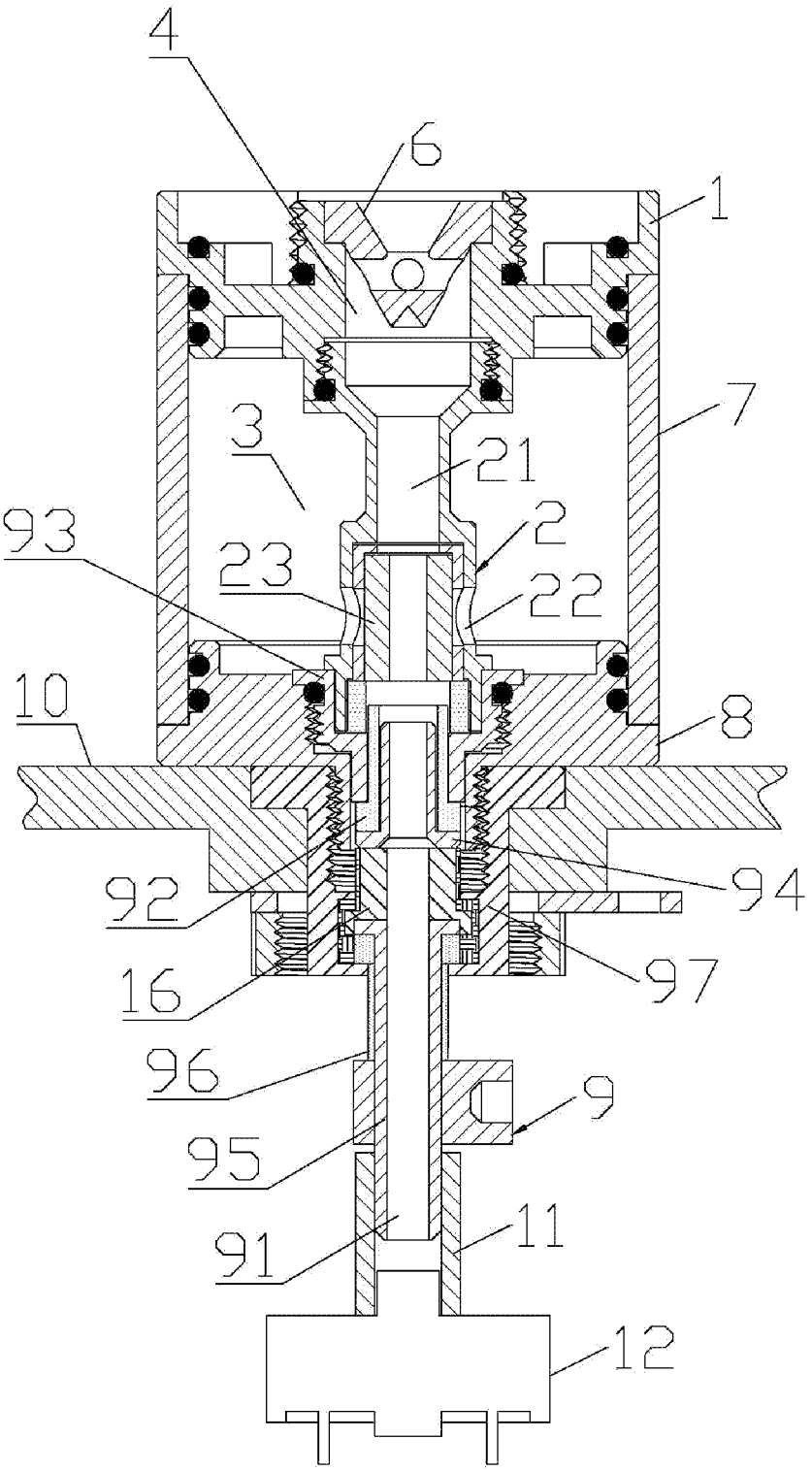
FIG. 14 shows a schematic structural diagram of an aerosol generator according to embodiment 1 of the present invention.

In this embodiment, as shown in FIG. 14, the atomizing device includes an atomizing member 2, an upper frame 1, a liquid storage chamber 3, and a lower frame 8, where the atomizing member 2 is located in the liquid storage chamber 3, and the atomizing member 2 and the liquid storage chamber 3 are both fixed between the upper frame 1 and the lower frame 8 hermetically. In addition, the atomizing member 2 is provided with an air passage 21 and a heating member 23, and a side of the atomizing member 2 is provided with a liquid guiding hole 22. The heating element 23 is located around the air passage 21, and an atomizing agent in the liquid storage chamber 3 penetrates to the heating element 23 through the liquid guiding hole 22 for heating and vaporization. The upper frame 1 is provided with an atomizing outlet hole 4, where the gas-electric hybrid junction 9 and the atomizing outlet hole 4 are respectively communicated with the air passage 21, and the gas source device sends cooling gas into the air passage 21 through the gas-electric hybrid junction 9.

Figure 1:
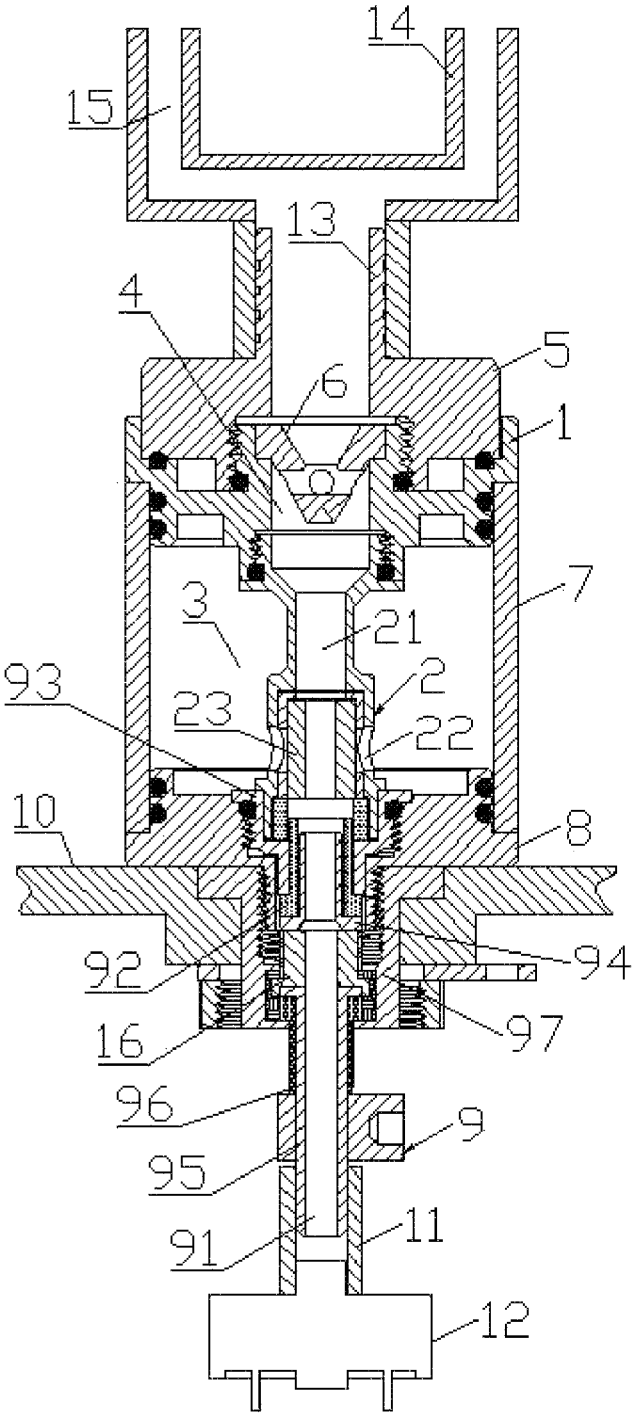
FIG. 1 shows a schematic structural diagram of an aerosol generator according to embodiment 1 of the present invention.
Figure 2:
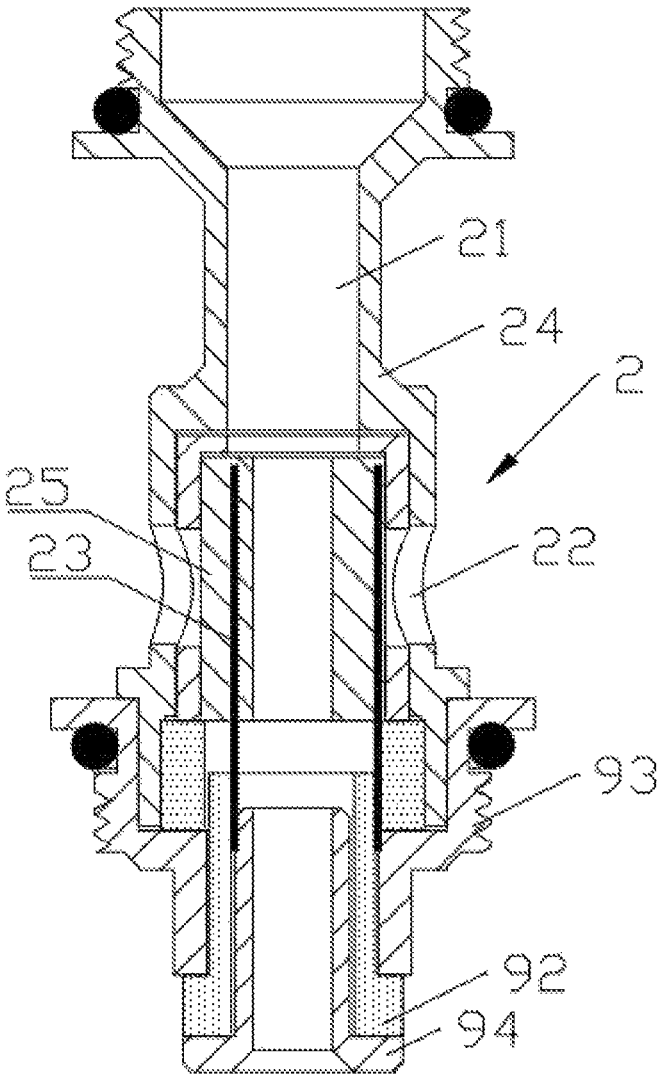
FIG. 2 shows a schematic structural diagram of a connection mode 1 of an atomizing member and a fixed joint according to embodiment 1 of the present invention.
Figure 3:
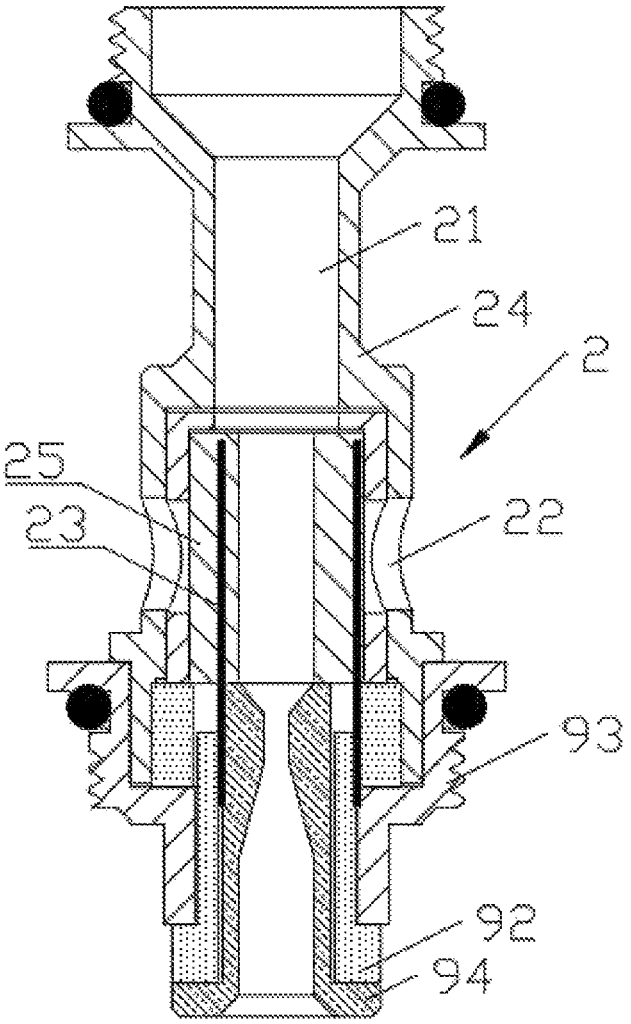
FIG. 3 shows a schematic structural diagram of a connection mode 2 of the atomizing member and the fixed joint according to embodiment 1 of the present invention.
Figure 4:
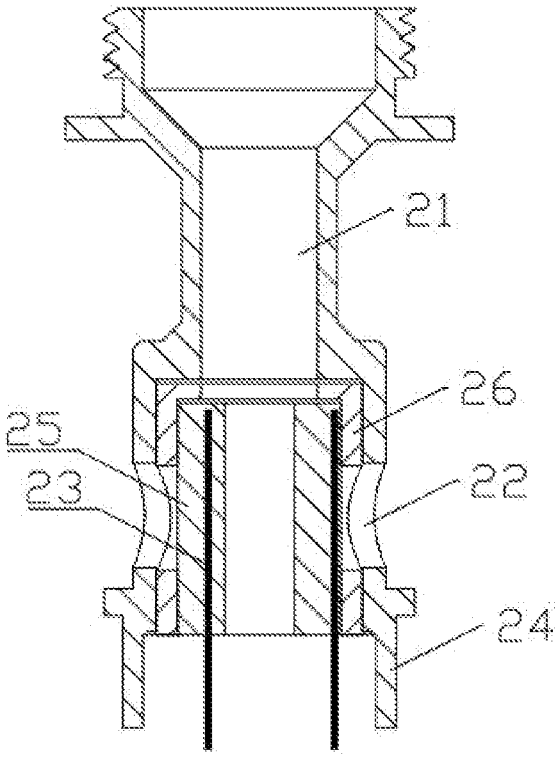
FIG. 4 shows a schematic structural diagram of the atomizing member according to embodiment 1 of the present invention.
Figure 5:
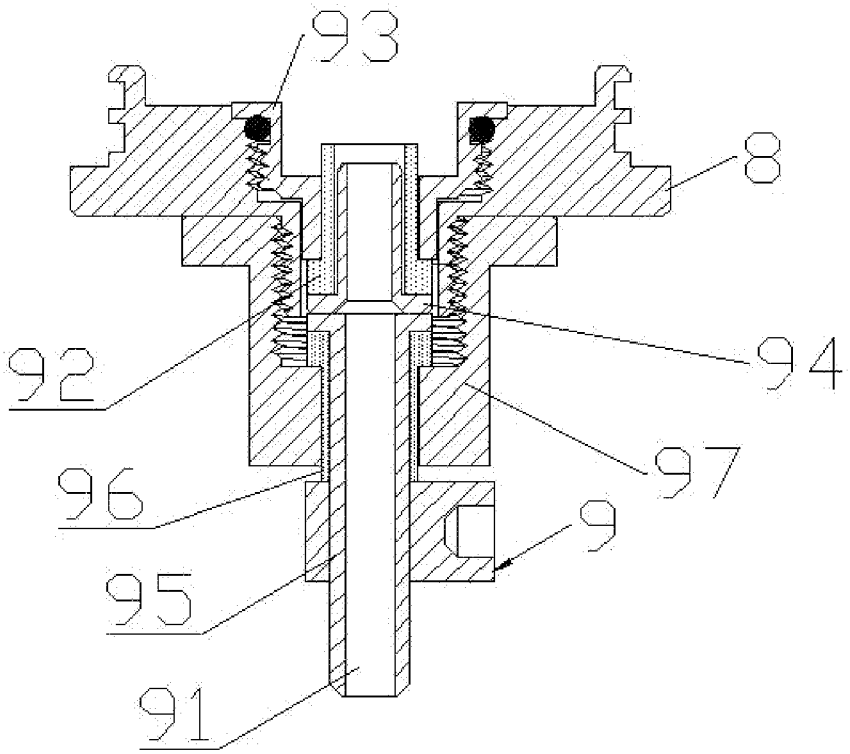
FIG. 5 shows a schematic structural diagram of a connection of a gas-electric hybrid junction and a lower frame according to embodiment 1 of the present invention.
Figure 6:
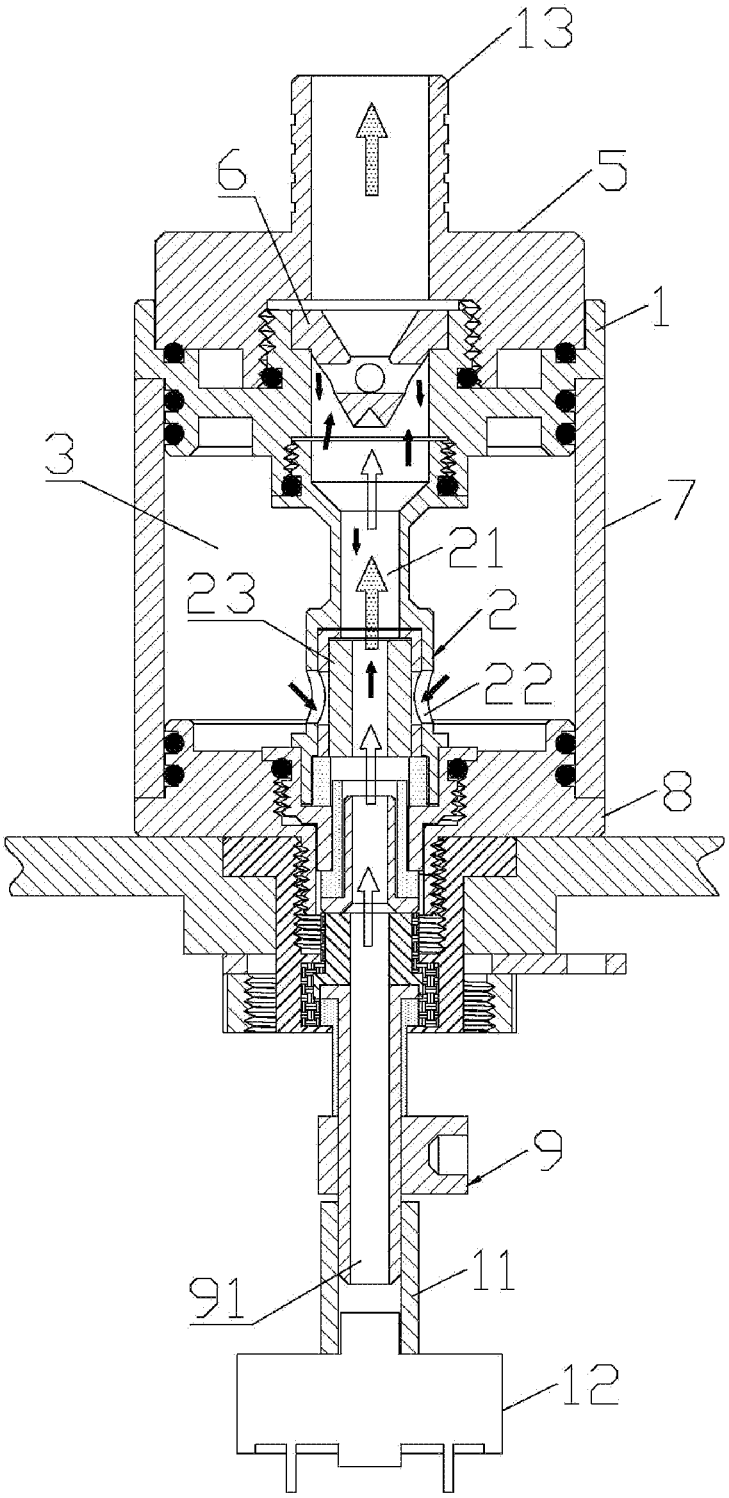
FIG. 6 shows a schematic diagram of the routes of a cooling gas, an atomizing agent, and an aerosol when the aerosol generator is working (in the figure, represents the route of the aerosol, represents the route of the cooling gas, and represents the route of the atomizing agent).

In actual application, the gas-electric hybrid junction 9 is usually communicated with an inlet of the air passage 21, and the atomizing outlet hole 4 is usually communicated with an outlet of the air passage 21. In order to enable the aerosol generator to adapt to different application scenarios, FIG. 6 shows the aerosol generator further including a top cover 5 and an atomizing outlet nozzle 13, where the top cover 5 and the atomizing outlet nozzle 13 are both arranged on the upper frame 1, and the atomizing outlet nozzle 13 is connected with the top cover 5 as a whole (for example, the top cover 5 can be installed on the top of the upper frame 1 through threads, and the atomizing outlet nozzle 13 is located on the top cover 5). A through hole in the atomizing outlet nozzle 13 is connected with the atomizing outlet hole 4. When the atomization agent is run out, the top cover 5 can be removed to facilitate users to supplement atomizing agent into the liquid storage chamber 3. Furthermore, in order to supplement the atomizing agent more conveniently, a liquid supplement tube can be provided on the top cover 5 (the liquid supplement tube is not shown in the figure), through which the atomizing agent can be continuously added to the liquid storage chamber 3. As shown in FIG. 1, the aerosol generator further includes an atomizing nozzle 14 or/and an atomizing outlet tube 15, where the atomizing outlet nozzle 13 is connected with the atomizing nozzle 14 or/and the atomizing outlet tube 15, which can meet the requirements of different application scenarios. For example, the atomizing nozzle 14 is mainly used in application scenarios such as a stage with a smoke special effect, and the atomizing outlet tube 15 is mainly used to extend the distance between the atomizing device and the atomization outlet. The atomization member 2 also includes an atomizing core 25 and a rack 24, where two ends of the rack 24 are respectively connected with the upper frame 1 and the lower frame 8 hermetically, the air passage 21 is located in the rack 24, the atomizing core 25 is fixed under the rack 24, a heating member 23 is fixed in the atomizing core 25, and the liquid guiding hole 22 is located outside the atomizing core 25. The atomizing device is further provided with a shell 7, where the shell 7 is hermetically connected with the upper frame 1 and the lower frame respectively, and the liquid storage chamber 3 is formed by a surround of the inner wall of the shell 7, the upper frame 1, the lower frame 8 and the outer wall of the rack 24. The aerosol generator further includes an outlet return element 6 which is located in the air passage 21. The structure of the outlet return element 6 is diversified, where an oil mist separator is a commonly used structure. The present invention takes the oil mist separator as an example for illustration: the oil mist separator can be designed as an inverted cone, a mesh type, a cyclone type structure, etc., which is surrounded by air inlets, and is provided with an inverted cone at the bottom. When the atomizing device is working, an aerosol is formed from an atomizing agent, then the aerosol in the air passage 21 and a high-temperature liquid atomizing agent in the air passage 21 will form an air-mist mixture, which is sprayed to the oil mist separator under the action of the air flow of the cooling gas. The bottom of the oil mist separator is provided with an inner diversion cone and an outer diversion cone, when the air-mist mixture hits the two diversion cones, interference and deceleration are performed on the sprayed air-mist mixture due to a reverse airflow formed from the inner diversion cone, meanwhile, another deceleration is performed on the sprayed air-mist mixture due to a reverse airflow formed from the outer diversion cone. In this case, the liquid atomizing agent will condense on the surface of the oil mist separator and return to the air passage 21 for reheating and revaporization, and the aerosol will pass through the holes on the side wall of the oil mist separator and be ejected out of the atomizing device under the action of air pressure because of the small molecule of the aerosol. Therefore, the high-temperature liquid atomizing agent is filtered, which lowers the temperature of the aerosol, prevents the user or other person from the risk of burns caused by the atomizing device, and ensures use safety. In addition, the oil mist separator generally can employ different structures (for example, inverted cone, mesh type, cyclone type) to separate the condensed fluid (usually referring to a condensed liquid atomizing agent) and the aerosol according to the viscosity and the boiling point of the atomizing agent and the flow rate of the air-cooling gas. Under the action of the cooling gas, as the aerosol and the condensed fluid with large particles pass through the oil mist separator, the oil mist separator diverts the airflow in the air passage 21 and then a vortex airflow is formed. The condensed fluid is collected on the surface of the oil mist separator and returns along the wall of the oil mist separator, while the aerosol is ejected after being recollected through small holes located at the side wall of the oil mist separator or extended curved channels under the action of air pressure. Furthermore, a containment shell 26 is arranged between the atomizing core 25 and the rack 24 in the aerosol generator. The shell 7 is hermetically connected with the outer surfaces of the upper frame and the lower frame 8, respectively. The atomizing core 25 can be selected according to different situations. For example, the atomizing core 25 can be made of porous ceramic material with the heating member 23 inside, non-woven fabric with good temperature resistance, or liquid storage material (such as glass fiber cotton) and atomizing wire, and the like. The air passage 21 is located inside the rack 24, the atomizing core 25 is fixed in the lower part of the rack 24, the heating member 23 is fixed inside the atomizing core 25, the liquid guiding hole 22 is located outside the atomizing core 25, the liquid storage chamber 3 is located between the rack 24 and the shell 7, and the liquid storage chamber is filled with the atomizing agent. The atomizing agent generally penetrates to the heating member 23 through the liquid guiding material in the liquid guiding hole 22 for heating and vaporization, i.e., the atomizing agent vaporizes at the side where the heating member 23 is in contact with the air passage 21 after being heated by the heating member 23. In this case, the gas source device 12 sends the cooling gas into the air passage 21 through the gas-electric hybrid junction 9, and the cooling gas in the air passage 21 cools down the atomizing agent in a high-temperature gas state immediately to form the aerosol due to a sudden condensation. Therefore, the atomizing agent undergoes a "liquid-gas-liquid" physical change inside the atomizing device to form an aerosol. In addition, the particle size and concentration of the aerosol can be adjusted by controlling the airflow velocity of the cooling gas. The liquid guiding material has the characteristics of absorbing the atomizing agent, heat resistance, liquid storage, and heat conduction, therefore, when the atomizing agent on a side of the liquid guiding material with a high temperature is vaporized and then reduced, a side of the liquid guiding material with a low temperature will absorb the atomizing agent on the side with the high temperature under the action of penetration, so as to supplement the atomizing agent. In this way, the atomizing agent in the liquid storage chamber 3 continuously penetrates to the heating member 23 under the action of penetration, the atomization process of "liquid-gas-liquid" is continuously repeated, and the atomizing device does not need to be preheated. Considering the heating member 23 only heats a small amount of the penetrated atomizing agent, a sustainable, instantaneous, and room-temperature aerosol can be provided. The two ends of the rack 24 are hermetically connected with the upper frame 1 and the lower frame 8 through threads and sealing rings respectively. Since the air passage 21 is located in the rack 24, the atomizing core 25 is fixed in the lower part of the rack 24, when the atomizing member 2 is damaged, the specific replacement operation is as follows: the operator first opens the upper frame 1 and then takes out the entire atomizing member 2 for replacement, or the professional takes out the atomizing member and replaces the atomizing core 25, thereby reducing the maintenance cost of the atomizing device.

In application, the heating member 23 is generally an atomizing wire coated with a liquid-guiding material, and the heating member 23 only heats and vaporizes a small amount of the penetrated atomizing agent, therefore, the atomizing device does not need to be preheated. The power of the atomizing member is generally in the range of 5-200 W, and the boiling point temperature of the atomizing agent can be any temperature in the range of 50-300° C. Due to the low temperature and simple structure, the size of the atomizing device can be appropriately reduced. The cooling gas may be air, inert gas, carbon dioxide, or other types of gas. The gas source device 12 provides the cooling gas with a pressure of 0.002-0.7 Mpa, and the pressure can be adjusted according to actual needs (for example, the outlet amount of aerosol, the aperture of the air passage 21, etc). After the aerosol is formed from the atomizing agent, the particle size and concentration of the aerosol can be adjusted by controlling the velocity of the cooling gas, and the temperature of the aerosol can be adjusted by controlling the heating power of the heating member 23, the heat dissipation power of the cooling gas and the viscosity of the atomizing agent. For example, after the aerosol is formed from the atomizing agent, the temperature of the aerosol can be adjusted by controlling the heating power of the heating member 23, the heat dissipation power of the cooling gas, and the viscosity of the atomizing agent. Specifically, the voltage in the circuit can be regulated through variable resistance, PMW, PLD, etc. to achieve a quantitative control of the heating power of the heating member 23. The power of the gas source device 12 (e.g., gas pump), the pressure of the compressed gas, or the structure of the air passage 21 can be regulated to achieve a quantitative control of the volume, velocity, and pressure of the cooling gas directly or indirectly, thus controlling the heat dissipation power of the cooling gas. In the atomization process, the boiling point temperature of the atomizing agent in the range of 50-300° C. can be accurately controlled by adjusting the heating power of the heating member 23 and the heat dissipation power of the cooling gas. In addition, it is also possible to adjust the viscosity of the atomizing agent, as well as the liquid-storage and liquid-guiding materials, to improve the dynamic atomization volume of the atomizing agent and further stabilize the atomization temperature. Therefore, the atomization solution of the present invention has excellent adaptability to the atomizing agent and can be applied to water-based and oil-based atomizing agents. Regarding the atomizing agent requiring high chemical stability such as insecticides, fungicides, drugs, and the like, the atomizing device of the present invention can realize precise temperature control. After the aerosol is formed from the atomizing agent, the particle size and concentration of the aerosol can be adjusted by controlling the velocity of the cooling gas, and the aperture of the air passage 21 can be designed according to actual needs.

The aerosol generator is further provided with a gas tube 11, and the air passage is provided in the middle of the gas-electric hybrid junction 9, where one end of the gas tube 11 is connected to the gas source device 12, and the other end of the gas tube 11 is connected to the air passage 21, so that the gas source device 12 sends the cooling gas from the bottom of the atomizing member 2 to the air passage 21 through the gas tube 11 and the air passage 21. In this way, the atomizing member 2, the air passage 21 which is located at the bottom of the atomizing device and the uniquely connected with the outside, the gas-electric hybrid junction 9, the gas tube 11 and the gas source device 12 form a closed space. Therefore, an air inlet channel (i.e. the closed space) is always closed regardless of whether the atomizing device is in a working or non-working state, so that the liquid or condensed liquid (usually the atomizing agent) inside the atomizing device cannot leak out of the atomizing device through the air inlet channel. The heating member is connected with the power supply through the gas-electric hybrid junction 9. The power supply can be a DC power supply, an AC power supply, a battery, or the like. When a battery is selected as the power supply, installation and replacement are relatively convenient. The lower frame 8 can be made from a conductive material (for example, metal material), and the middle of the lower frame 8 is provided with a mounting hole. The gas-electric hybrid junction 9 is used as the connection port of the atomizing member 2 to separate the air inlet channel and circuit of the atomizing member 2 from or connect the air inlet channel and circuit of the atomizing member 2 with external components (for example, the gas source device 12 and the power supply), and the connection type of which can be a thread connection, a buckle connection, a bolt connection, a flange connection, or the like. The gas-electric hybrid junction 9 has multifarious structures, for example, the gas-electric hybrid junction 9 includes a fixed joint and a movable joint, where the fixed joint includes a first insulating ring 92, a positive base 2-93, and a negative fixing head 94. The positive base 2-93 is fixed in the mounting hole which is arranged in the middle of the lower frame 8, a lower end of the rack 24 is fixed on the positive base 2-93, the first insulating ring 92 is located between the negative fixing head 94 and the positive base 2-93, and the negative electrode and the positive electrode of the heating member 23 are separated by the first insulating ring 92 (the positive electrode and the negative electrode of the heating member 23 can be exchanged according to the use of the atomizing device). Specifically, the positive electrode of the heating member 23 is pressed against the positive base 2-93 through the outer side of the first insulating ring 92, and the negative electrode of the heating member 23 is pressed against the negative fixing head 94 through the inner side of the first insulating ring 92. The movable joint includes a second insulating ring 96, a positive connecting seat 97, and a negative connecting head 95, where the second insulating ring 96 is located between the positive connecting seat 97 and the negative connecting head 95. When the fixed joint is connected with the movable joint, the positive connecting seat 97 is fixed below the lower frame 8, the negative connecting head is tightly attached to the negative fixing head 94, the positive electrode of the heating member 23 is connected to the positive electrode of the power supply through the positive base 2-93, the lower frame 8 and the positive connecting seat 97 respectively, and the negative electrode of the heating member 23 is connected to the negative electrode of the power supply through the negative fixing head 94 and the negative connecting head 95 respectively. The positive connecting seat 97 can be removed from the bottom of the lower frame 8 to separate the fixed joint from the movable joint, and the positive electrode and negative electrode of the heating member 23 are disconnected from the power supply respectively. In order to fix the position of the atomizing device conveniently, the atomizing device is provided with a mounting plate 10, where the positive connecting seat 97 is connected with the mounting plate 10, and the mounting plate 10 is arranged on one side of the driving device of the atomizing device. The driving device can be in various forms, which is not limited to the example of a seat type, a hand-held type, a split type, etc.

Figure 13:
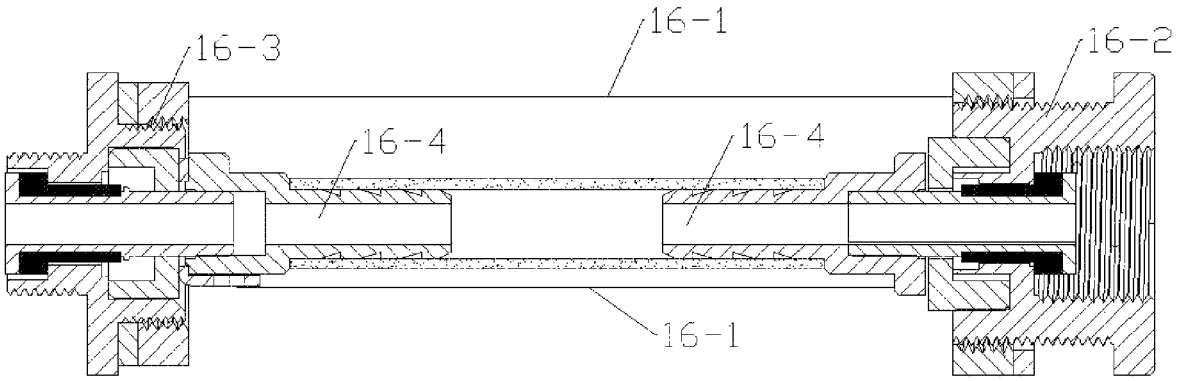
FIG. 13 shows a cross-sectional structural diagram of a gas-electric extension cable in the aerosol generator according to an embodiment of the present invention.

In practical applications, the velocity of the cooling gas in the air passage 21 at different positions can be adjusted locally by changing the local structure of the air passage 21 and the aperture size of the air passage 21, thus adjusting the pressure of the cooling gas in the air passage 21. In the present invention, the cooling gas is accelerated or pressurized by changing the aperture of the local air passage 21 in the gas-electric hybrid junction 9, thereby realizing a specific functional application (for example, the principle of Laval nozzle, the principle of Venturi tube). And many specific application structures are adaptable. For example, the aperture of the air passage at the connection of the negative fixing head 94 and the atomizing core 25 is smaller than that of the air passage in the atomizing core 25, so that the pressure in the air passage 21 in the atomizing core 25 is smaller than that in the liquid storage chamber 3, which is conducive to the penetration of the atomizing agent from the liquid storage chamber 3 to the heating member 23 for heating and prevents the pressure in the liquid storage chamber 3 from changing due to the pressure of the cooling gas. In addition, the aerosol generator is provided with a gas-electric extension cable 16, where one end of the gas-electric extension cable 16 is connected to the fixed joint, and the other end of the gas-electric extension cable 16 is connected to the movable joint. The cooling gas is sent into the atomizing core 25 through the air passage 21, the fixed joint, the gas-electric extension cable 16, and the movable joint in sequence. The heating member 23 is connected to the power supply through the movable joint, the gas-electric extension cable 16, and the fixed joint in sequence. The gas-electric extension cable 16 can meet the actual needs of users for convenience or specific application scenarios. For example, for the performance scenes such as magic, the atomizing device has a relatively large size, and the use of which will be limited when it is necessary to hide the atomizing device in performance costumes or props. The gas-electric extension cable 16 can be used in this case to independently lead out the modular atomizing device, to realize split atomization, and although the distance between the atomizing device in the modular aerosol generator and the gas source device 12 is relatively long, the aerosol generator equipped with the gas-electric extension cable 16 can meet the actual needs of the performance scene, due to that one end of the gas-electric extension cable 16 is connected to the fixed joint, and the other end of the gas-electric extension cable 16 is connected to the movable joint. As shown in FIG. 13, the gas-electric extension cable 16 generally includes two or more wires 16-1, an inlet tube 16-2, and an outlet tube 16-3. The heating member 23 is connected to the power supply through the movable joint, the two or more wires 16-1, and the fixed joint in sequence.

The insides of the inlet tube 16-2 and the outlet tube 16-3 are both provided with vent holes 16-4, and the vent holes 16-4 are connected to the air passage 21. The inlet tube 16-2 is connected to the fixed joint, and the outlet tube 16-3 is connected to the movable joint. When the aerosol generator is provided with multiple atomizing devices, the gas-electric extension cable 16 is designed with an inlet tube 16-2 and multiple outlet tubes 16-3, the gas-electric hybrid junction 9 is designed with a fixed joint and multiple movable joints, where the fixed joint is connected to the inlet tube 16-2, the multiple outlet tubes 16-3 are connected to the inlet tube 16-2, and each outlet tube 16-3 is connected to a corresponding atomizing device. When the aerosol generator is provided with multiple gas source devices, the gas-electric extension cable 16 is designed with multiple inlet tubes 16-2 and an outlet tube 16-3, the gas-electric hybrid junction 9 is designed with multiple fixed joints and a movable joint, where each of the gas source devices is connected to a corresponding fixed joint, each of the fixed joints is then connected to a corresponding inlet tube 16-2; the multiple inlet tubes 16-2 are connected to the outlet tube 16-3, and the outlet tube 16-3 is connected to the movable joint.

The advantages of the present invention are as follows: the aerosol generator of the present invention includes the atomizing member 2, the gas-electric hybrid junction 9, the gas source device 12, the upper frame 1, the liquid storage chamber 3, and the lower frame 8. Since the atomizing member 2 and the liquid storage chamber 3 are both fixed between the upper frame 1 and the lower frame 8 hermetically, the atomizing agent can be prevented from leaking from the liquid storage chamber 3. The air passage 21 and the heating member 23 are arranged in the atomizing member 2, the heating member 23 is located around the air passage 21, so that the atomizing agent in the liquid storage chamber 3 can penetrate to the heating member 23 through the liquid-guiding hole 22. After being heated by the heating member 23, the atomizing agent is vaporized at the side where the heating member 23 is in contact with the air passage 21. And the gas-electric hybrid junction 9 and the atomizing outlet hole 4 are respectively communicated with the air passage 21, so that the gas source device 12 sends the cooling gas into the air passage 21 through the gas-electric hybrid junction 9. Then the atomizing agent in the high-temperature gas state is cooled down by the cooling gas and condensed to form an aerosol due to the sudden cooling, which realizes forming an aerosol from the atomizing agent through the physical change of "liquid-gas-liquid" inside the atomizing device. The particle size and concentration of the aerosol can be adjusted by controlling the velocity of the cooling gas, and the temperature of the aerosol can be adjusted by controlling the heating power of the heating member 23, the heat dissipation power of the cooling gas, and the viscosity of the atomizing agent. Compared with the traditional ultrasonic vibration method and the abrupt pressure drop method, the obtained aerosol of the present invention has finer particles, and the control of particle size and concentration of the aerosol in the present invention can be more conveniently controlled.

The heating member 23 in the present invention heats and vaporizes a small amount of the penetrated atomizing agent, and then the atomizing agent in the gas state immediately forms an aerosol under the action of the cooling gas and is blown out of the atomizing device. Meanwhile, the atomizing agent in the liquid storage chamber 3 continuously penetrates to the heating member 23 under the action of the permeation effect, so that the "liquid-gas-liquid" atomization process can be continuously repeated. Therefore, the atomizing device of the present invention can provide an aerosol with normal temperature sustainably and instantaneously, does not need to be preheated, can work under the power range of 5-200 W, and can be directly driven by a small-capacity lithium battery, resulting in meeting the requirements of different scenarios. The cooling gas is generally selected from air, inert gas, and carbon dioxide (other types of gases can also be used). Since the cooling gas is sent into the air passage 21 to quickly cool down the atomizing agent in the high-temperature gas state to form an aerosol with normal temperature, the risk of burns is prevented and the use safety is ensured for users and other persons. In addition, there is an air hole 91 arranged in the middle of the gas-electric hybrid junction 9, and the gas source device 12 located outside the atomizing main structure is communicated with the air passage 21 through the gas tube 11 and the air hole 91, which constitutes an air inlet channel of the atomizing device, so that the atomizing member 2, the air passage 21 that is located at the bottom of the atomizing main structure and uniquely connected to the outside, the gas-electric hybrid junction 9, the gas tube 11 and the gas source device 12 form a closed space. Therefore, the air inlet channel is always closed whether the atomizing device is in a working or non-working state, thus the liquid or condensed liquid (usually the atomizing agent) inside the atomizing device cannot leak out of the atomizing device through the air inlet channel.

Furthermore, the atomizing device has a compact structure and a small volume due to that the heating member 23 in the atomizing member 2 is connected with the power supply through the gas-electric hybrid junction 9; the low power of the atomizing device also greatly reduces the size of the atomizing device, thus hand-held or rechargeable applications and convenience to carry are realized. Last but not least, the atomizing member 2 is provided with the atomizing core 25 and the rack 24, where the air passage is located inside the rack 24, the atomizing core 25 is fixed in the lower part of the rack 24, and the two ends of the rack 24 are hermetically connected with the upper frame 1 and the lower frame 8 respectively, thereby the atomizing core 25 or the atomizing member 2 can be replaced independently. The gas-electric hybrid junction 9 includes the fixed joint and the movable joint, where the fixed joint is installed on the lower frame 8 of the atomizing device and is generally connected to the movable joint through threads, thus the connection and separation of the fixed joint and the movable joint can be simply realized through rotating threads. When the atomizing device is in a working state, the movable joint is connected with the fixed joint to enable the connection of the positive and negative electrodes of the heating member 23, the power supply, and the air passage 21, which greatly reduces the required space. If the atomizing core 25 or the atomizing device is damaged after long-term use, the atomizing core 25 or the atomizing member 2 can be modularly replaced. If the gas source device 12, the fixed joint, the movable joint, and the power supply are damaged after long-term use, the damaged components can be replaced independently, thus the product maintenance and replacement are very convenient, which is conducive for scale production of the atomizing device, and greatly reduces the production cost and maintenance cost of the atomizing device.

Embodiment 2

As shown in FIGS. 7-11 and 15, a modular aerosol generator includes an atomizing device, and the aerosol generator further includes a gas-electric hybrid junction 9 and a gas source device 12, where the atomizing device is provided with an air passage 21 located at a bottom of the atomizing device. The atomizing device is connected to a power supply via the gas-electric hybrid junction 9, and the gas source device 12 is connected with the air passage 21 via the gas-electric hybrid junction 9 and provides a cooling gas.

Figure 15:
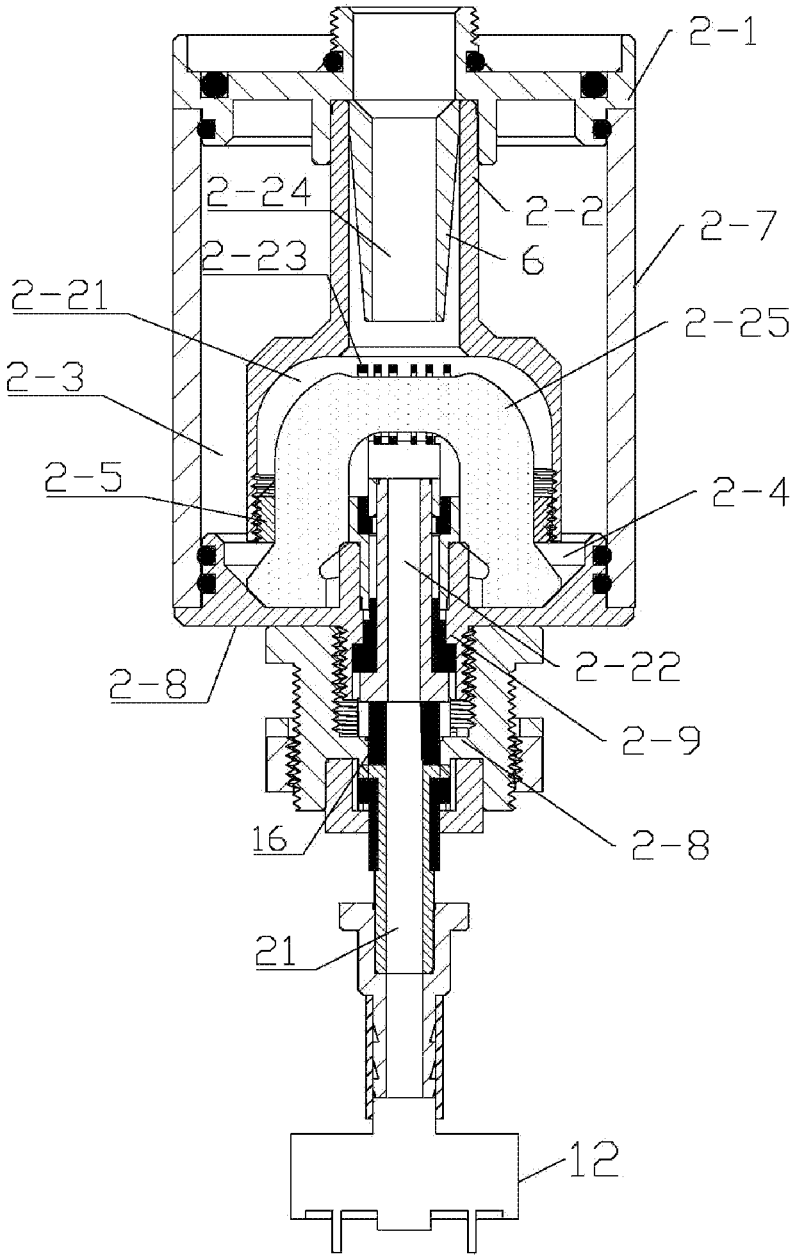
FIG. 15 shows a schematic structural diagram of an aerosol generator according to embodiment 2 of the present invention.

In practical application, as shown in FIG. 15, the atomizing device includes an upper frame 2-1, a liquid storage chamber 2-3, an atomizing member 2-2, and a lower frame 2-8, where the atomizing member 2-2 is installed in the liquid storage chamber 2-3, the atomizing member 2-2 and the liquid storage chamber 2-3 are hermetically fixed between the upper frame 2-1 and the lower frame 2-8. The atomizing member 2-2 includes an atomizing chamber 2-21, an atomizing wire 2-23, and an oil-guiding member 2-25 which are located in the lower part of the atomizing member. A cooling channel 2-22 located at the bottom of the atomizing chamber and an atomizing outlet channel 2-24 located at the top of the atomizing chamber constitute an air passage 21. The atomizing wire 2-23 is located in the atomizing chamber 2-21 and is fixed at the entrance of the atomizing outlet channel 2-24. An atomizing agent in the liquid storage chamber 2-3 penetrates to the atomizing wire 2-23 through the oil-guiding member 2-25 for heating and vaporization, and the cooling gas is fed into the atomizing chamber 2-21 through the cooling channel 2-22.

In practical application, the atomizing device is provided with a shell 2-7 hermetically connected to the upper frame 2-1 and the lower frame 2-8 respectively, where the surround of the upper frame 2-1, the atomizing member 2-2, the shell 2-7 and the lower frame 2-8 forms the liquid storage chamber 2-3, and the upper frame 2-1 and the lower frame 2-8 are hermetically fixed at both ends of the shell 2-7. A liquid-guiding chamber 2-4 is arranged at a top of the lower frame 2-8 so that the atomizing device can provide sustainable and instantaneous aerosol, where the liquid-guiding chamber 2-4 is communication with the liquid storage chamber 2-3. Since the liquid-guiding chamber 2-4 is located at the bottom of the liquid storage chamber 2-3, all the atomizing agent in the liquid storage chamber 2-3 can flow into the liquid-guiding chamber 2-4. In addition, the top of the cooling channel 2-22 is higher than the top of the liquid-guiding chamber 2-4 to prevent the atomizing agent from entering the atomizing chamber 2-21 through the cooling channel 2-22.

In practical application, the liquid-guiding chamber 2-4 adopts a "big top and small bottom" structure, for example, the outside surface of the bottom of the liquid-guiding chamber 2-4 can be an inverted cone, or the outside surface of the bottom of the liquid-guiding chamber 2-4 can be a circular arc inclined plane, where the outside of the bottom of the liquid-guiding chamber 2-4 is supplemented by the oil-guiding member 2-25, and the supplemented area is designed according to the actual situation (for example, the middle part of the oil-guiding member 2-25 is fixed in the atomizing wire 2-23, the two ends of the oil-guiding member 2-25 are used to supplement the outside of the bottom of the liquid-guiding chamber 2-4). Oil supply in the aerosol generator of the present invention is based on the capillary principle, and the oil-guiding member 2-25 is made of flexible fiber fabric materials with good temperature resistance, such as solid materials with tiny voids (for example, cotton, glass fiber, asbestos, etc.) or solid materials with rich voids (for example, porous ceramics, diatom ooze, gypsum, cement, etc.), which enables the atomizing agent to penetrate from the wetter side to the drier side based on the capillary principle. The atomizing wire 2-23 is made of metal with good heat resistance, and the resistance value of the atomizing wire 2-23 may be in a range of 0.05-25 ohms. For example, the atomizing wire 2-23 can be made of stainless steel, nickel alloy, or tungsten wire. The resistance value of the atomizing wire 2-23 may be in a range of 0.05-5 ohms, and the shape of the atomizing wire 2-23 can be designed according to the actual situation (for example, one or more shapes of a spiral, a tube, a mesh, and a sheet). The liquid storage chamber 2-3 and the atomizing chamber 2-21 are two independent spaces, the atomizing agent in the liquid storage chamber 2-3 penetrates to the atomizing wire 2-23 via the oil-guiding member 2-25. The atomizing wire 2-23 only needs to heat the limited penetrated atomizing agent in the oil-guiding member 2-25, thus effectively reducing the heating load of the atomizing wire 2-23, and realizing instantaneous atomization and low power consumption. As a result, a small-capacity lithium battery can be used as the power supply to drive the aerosol generator directly, which facilitates the replacement of the power supply, and the resistance value of the atomizing wire 2-23 is small, therefore, the aerosol generator can meet the requirements of different scenarios under the power condition of less than 200 W. Due to the oil supply is based on the capillary principle, the oil-guiding member 2-25 may be made of flexible fiber fabric materials with good temperature resistance or solid material with tiny voids, and the liquid storage chamber 2-3 is in communication with the liquid-guiding chamber 2-4, the atomizing agent in the liquid storage chamber 2-3 can continuously penetrate to the atomizing wire 2-23 under the action of negative pressure and permeation effect, therefore, the "liquid-gas-liquid" atomization process is continuously repeated, thereby realizing the continuously supply of the atomizing agent during the working process when the normal line of the aerosol generator at any angle in the range from horizontal to vertical under the combination of the liquid-guiding chamber 2-4 and the oil-guiding member 2-25. With the consumption of the atomizing agent in the liquid storage chamber 2-3, the negative pressure in the liquid storage chamber 2-3 can prevent the aerosol generator from poor atomization effect due to excessive atomizing agent. Therefore, the aerosol generator of the present invention can provide aerosol with a good atomization effect sustainably and instantaneously, and no preheating is required.

In practical application, the middle of the lower frame 2-8 in the aerosol generator is provided with a mounting hole, and the gas-electric hybrid junction 9 passes through the mounting hole and is hermetically connected with the lower frame 2-8 to prevent the atomizing agent from leaking out of the mounting hole. The atomizing wire 2-23 is connected to the power supply via the gas-electric hybrid junction. The air passage 21 is arranged in the gas-electric hybrid junction 9, and the cooling gas is fed into the atomizing chamber 2-21 through the air passage 21 and the cooling channel 2-22 in sequence.

In practical application, the gas-electric hybrid junction 9 includes a fixed joint 2-8 and a movable joint 2-9 to disassemble the aerosol generator conveniently, where the fixed joint 2-8 and the movable joint 2-9 can turn on or off the positive and negative electrodes of the power supply and the gas source of the cooling gas. There are many connection modes between the fixed joint 2-8 and the movable joint 2-9, but the following must be guaranteed: when the fixed joint 2-8 is connected with the movable joint 2-9, the positive electrode and negative electrode of the power supply need to be connected to the two ends of the atomizing wire 2-23 through the gas-electric hybrid junction 9, and the cooling channel 2-22 need to be connected to the gas source device 12 through the gas-electric hybrid junction 9; when the fixed joint 2-8 is disconnected from the movable joint 2-9, the positive electrode and negative electrode of the power supply need to be disconnected from the two ends of the atomizing wire 2-23, and the cooling channel 2-22 need to be disconnected from the gas source device 12 through the gas-electric hybrid junction 9. The connection mode of the fixed joint 2-8 and the movable joint 2-9 can be as follows: in a first embodiment, the movable joint 2-9 is connected with the fixed joint 2-8 through a thread; in a second embodiment, the movable joint 2-9 is connected with the fixed joint 2-8 through a buckle; in a third embodiment, the movable joint 2-9 is connected with the fixed joint 2-8 through pressing by an external force or through magnetic suction. That is to say, the movable joint 2-9 can be connected to the fixed joint 2-8 through a thread, a buckle, an external force pressing, or a magnetic suction. Preferably, the fixed joint 2-8 is connected with the movable joint 2-9 through a thread to realize the connection and separation of the fixed joint 2-8 and the movable joint 2-9. When the aerosol generator is in a working state, the movable joint 2-9 and the fixed joint 2-8 are connected, the cooling channel 2-22 is connected to the gas source device 12 through the gas-electric hybrid junction 9, so that the atomizing wire 2-23 can be connected to the power supply, and then the space requirement is greatly reduced.

In practical application, the atomizing wire 2-23 is located directly below the atomizing outlet channel 2-24, the cooling channel 2-22 is located directly below the atomizing wire 2-23, and the top of the atomizing chambers on both sides of the atomizing outlet channel 2-24 are designed as arc-shaped, inverted cone-shaped, or cylindrical, so that after the cooling gas enters the atomizing chamber 2-21 through the cooling channel 2-22, it can directly act on the surface of the atomizing wire 2-23 to cool down the atomizing agent heated to a supersaturated state to form an aerosol. The barrier action of the atomizing wire 2-23 and the oil-guiding member 2-25 (the cooling channel 2-22 is located directly below the atomizing wire 2-23, and the middle of the oil-guiding member 2-25 is fixed inside the atomizing wire 2-23) enables the mixture of the aerosol vapor and the atomizing agent droplets to be split and sprayed to the side walls of the atomizing chamber 2-21 (the inner walls at the top of the atomizing chamber is designed as arc-shaped, inverted cone-shaped, or cylindrical). Then the aerosol vapor is ejected from the side walls to the atomizing outlet channel 2-24, and the condensed liquid flows back up or down along the side walls to the oil-guiding member 2-25 for reheating and revaporization. The aerosol generator is further provided with an outlet return element 2-6 located in the atomizing outlet channel 2-24, so that a few condensed liquid moving upward can return to the atomization chamber 2-21, which effectively inhibits the occurrence of oil ejection. The cooling gas is generally selected from air, inert gas, and carbon dioxide (other types of gases can also be used), and the pressure range of the cooling gas can be 0.002-0.7 MPa. Since the cooling gas is sent into the atomization chamber 2-21 via the air passage 21 and the cooling channel 2-22 in sequence to quickly cool down the atomizing agent in the high-temperature gas state to form an aerosol with normal temperature and good atomization effect, the risk of burns is prevented and the use safety is ensured for users and other persons.

In practical application, the movable joint 2-9 includes a first insulating ring 2-92, a positive base 2-93, and a negative fixing head 2-94, where the positive base 2-93 is fixed in the mounting hole of the lower frame 2-8, one end of the atomizing wire 2-23 is connected with the positive base 2-93, the other end of the atomizing wire 2-23 is connected with the negative fixing head 2-94. The lower frame 2-8, the positive base 2-93 and the negative fixing head 2-94 are all made of metal conductive materials. The first insulating ring 2-92 is located between the negative fixing head 2-94 and the positive base 2-93, which contributes to preventing the conductive phenomenon between the positive base 2-93 and the lower frame 2-8 or the negative fixing head 2-94. The fixed joint 2-8 includes a second insulating ring 2-96, a positive connecting seat 2-97, and a negative connecting head 2-95, where the positive connecting seat 2-97 and the negative connecting head 2-95 are both made of metal conductive materials. The second insulating ring 2-96 is located between the positive connecting seat 2-97 and the negative connecting head 2-95, which contributes to preventing the conductive phenomenon between the positive connecting seat 2-97 and the lower frame 2-8 or the negative connecting head 2-95. When the fixed joint 2-8 is connected with the movable joint 2-9, the air passage 21 is connected with the cooling channel 2-22, the negative fixing head 2-94 is arranged on the lower frame 2-8, the lower frame 2-8 is fixed on the negative connecting head 2-95 through a thread, a buckle, an external forces pressing, or a magnetic attraction (preferably, the lower frame 2-8 is connected with the negative connecting head 2-95 through a thread), the positive base 2-93 is attached to the positive connecting seat 2-97, one end of the atomizing wire 2-23 is connected to the positive electrode of the power supply through the positive base 2-93 and the positive connecting seat 2-97 respectively, and the other end of atomizing wire 2-23 is connected to the negative electrode of the power supply through the negative fixing head 2-94, the lower frame 2-8 and the negative connecting head 2-95 respectively. When the fixed joint 2-8 is disconnected from the movable joint 2-9, the negative connecting head 2-95 can be detached from the lower frame 2-8, and the atomizing wire 2-23 is disconnected from the power supply respectively. In addition, a support 2-10 may be arranged on the outer side of the negative connecting head 2-95 to facilitate the installation of the fixed joint 2-8. For example, the support 2-10 can be directly fixed on the outer side of the negative connecting head 2-95 through a thread, so that the fixed joint 2-8 can be installed on other products or components through the support 2-10. The gas-electric hybrid junction 9 includes the fixed joint 2-8 and the movable joint 2-9, where the fixed joint 2-8 is typically installed on the driver main body of the aerosol generator or the led out-split mounting seat, and the atomizing device and the movable joint 2-9 are assembled to form the atomizing main body. The atomizing main body is used as a modular component with the movable joint 2-9 arranged on. Therefore, a thread, a buckle, an external force pressing, or a magnetic attraction can be utilized to realize the connection and separation of the fixed joint 2-8 and the movable interface 2-9. When the aerosol generator is in the working state, the movable joint 2-9 needs to be connected with the fixed joint 2-8, which connects the atomizing main body with the driver main body, connects the atomizing wire 2-23 with the power supply, and connects the cooling channel 2-22 with the gas source device 12, thus making the product a highly compact structure and miniaturizing and modularizing the aerosol generator. Because of the atomizing main body assembled from the atomizing device and the movable joint 2-9, the circuit of the atomizing main body connects the gas path reliably through the gas-electric hybrid junction, and the atomizing main body and the gas-electric hybrid junction can be easily installed and detached, so that the atomizing main body as an independent module can generate the aerosol with only providing the cooling gas and voltage required for the operation, which miniaturizes the aerosol generator and greatly expands the product use scenes. Atomizing elements in the aerosol generator of the present invention, such as liquid storage, aerosol generation, energy supply, and fixation, have been modularized, which can be quickly installed and detached through the gas-electric hybrid junction, so that the atomizing main body can be regarded as a standard part or consumable part which can be maintained and replaced as a standard atomization module with interchangeability according to the design life and actual needs. And the standard atomizing module can be produced on a large scale and reused, therefore, the cost of use can be greatly reduced.

An installing seat 2-5 may be provided in the aerosol generator to prevent the atomizing agent from leaking out of the atomizing outlet channel 2-24 when the aerosol generator is in inversion. The installing seat 2-5 is installed at the bottom of the atomizing chamber 2-21 and is connected with the inner side of the atomizing member 2-2 (for example, through a threaded connection), so that the liquid storage chamber 2-3 and the atomizing chamber 2-21 are two independent spaces. The installing seat 2-5 is provided with an oil-guiding hole, a positive connector 2-27, and a negative connector 2-28, where one end of the atomizing wire 2-23 is connected to the positive base 2-93 through the positive connector 2-27, the other end of the atomizing wire 2-23 is connected to the negative fixing head 2-94 through the negative connector 2-28, the middle of the oil-guiding member 2-25 passes through the atomizing wire 2-23 and is fixed in the atomizing wire 2-23, the two ends of the oil-guiding member 2-25 pass through the oil-guiding hole and fill the bottom of the liquid-guiding chamber 2-4. Considering the oil-guiding member 2-25 is made of flexible fiber fabric material with good temperature resistance or solid material with tiny voids, the bottom of the liquid-guiding chamber 2-4 is designed as inverted cone inclined plane-shaped, inverted cone-shaped, or arc inclined plane-shaped, and the two ends of the oil-guiding element 2-25 pass through the oil-guiding hole and fill the bottom of the liquid-guiding chamber 2-4. The atomizing agent in the liquid storage chamber 2-3 can continuously penetrate to the atomizing wire 2-23 under the action of permeation effect and negative pressure when the aerosol generator is in a working state, therefore, the "liquid-gas-liquid" atomization process can be continuously repeated and sustainable and instantaneous aerosol can be provided.

Figure 7:
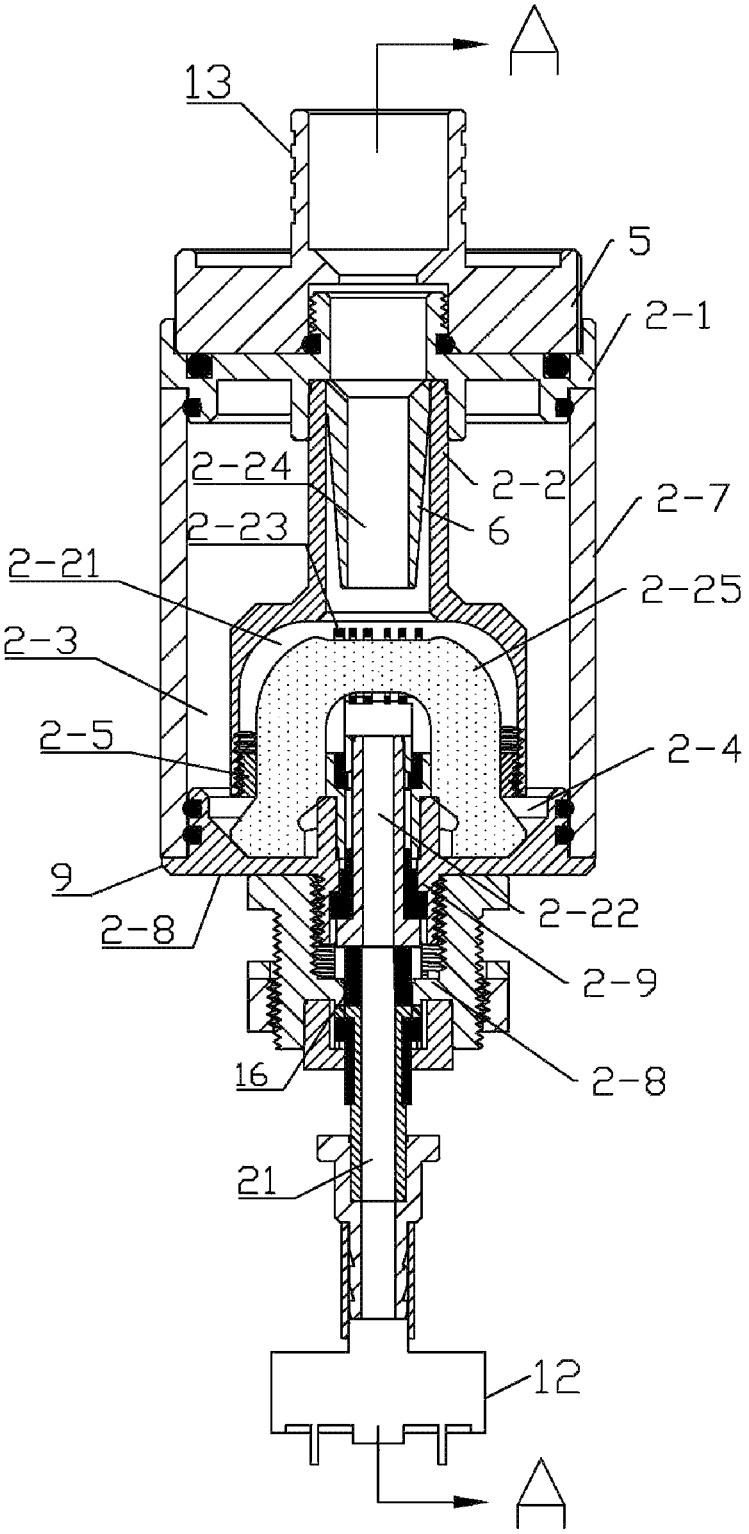
FIG. 7 shows a schematic cross-sectional diagram of an aerosol generator according to embodiment 2 of the present invention.
Figure 8:
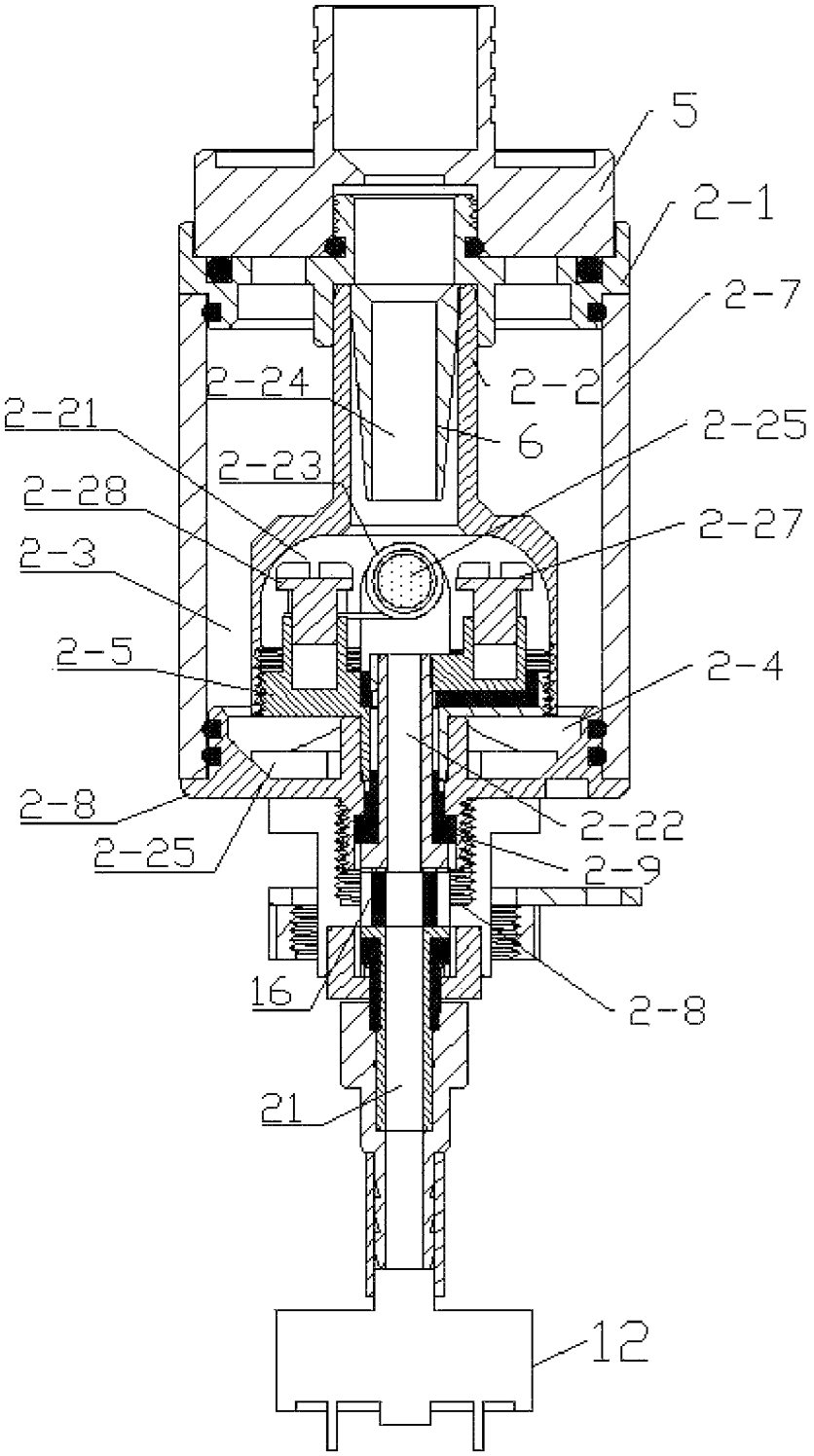
FIG. 8 shows a cross-sectional diagram along the A-A direction in FIG. 7.
Figure 9:
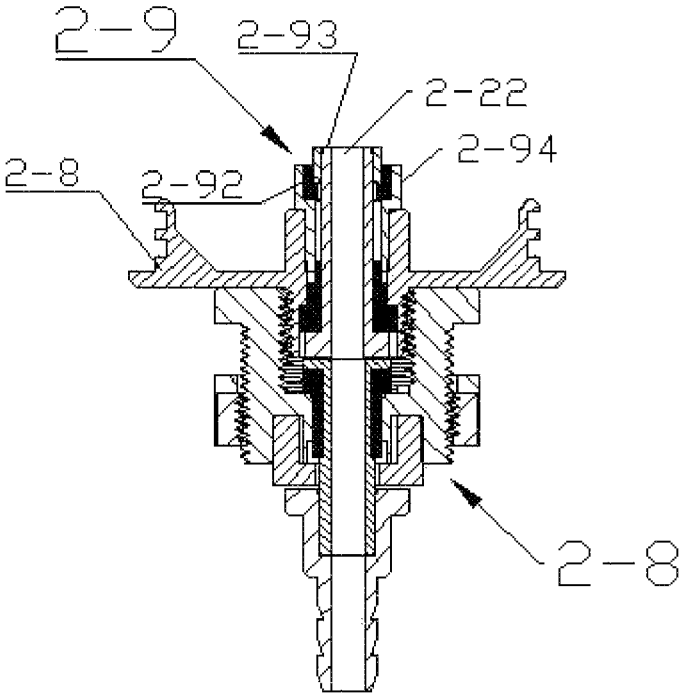
FIG. 9 shows a schematic structural diagram of a connection of a gas-electric hybrid junction and a lower frame according to embodiment 2 of the present invention.
Figure 10:
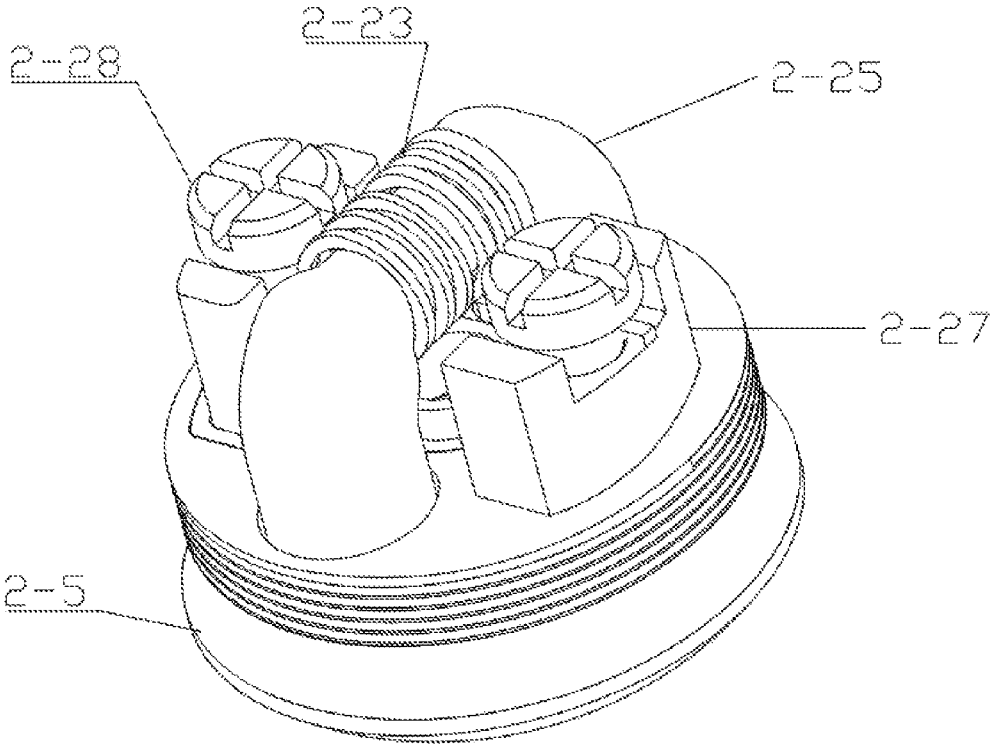
FIG. 10 shows a schematic structural diagram of an installing seat and an oil-guiding member according to embodiment 2 of the present invention.
Figure 11:
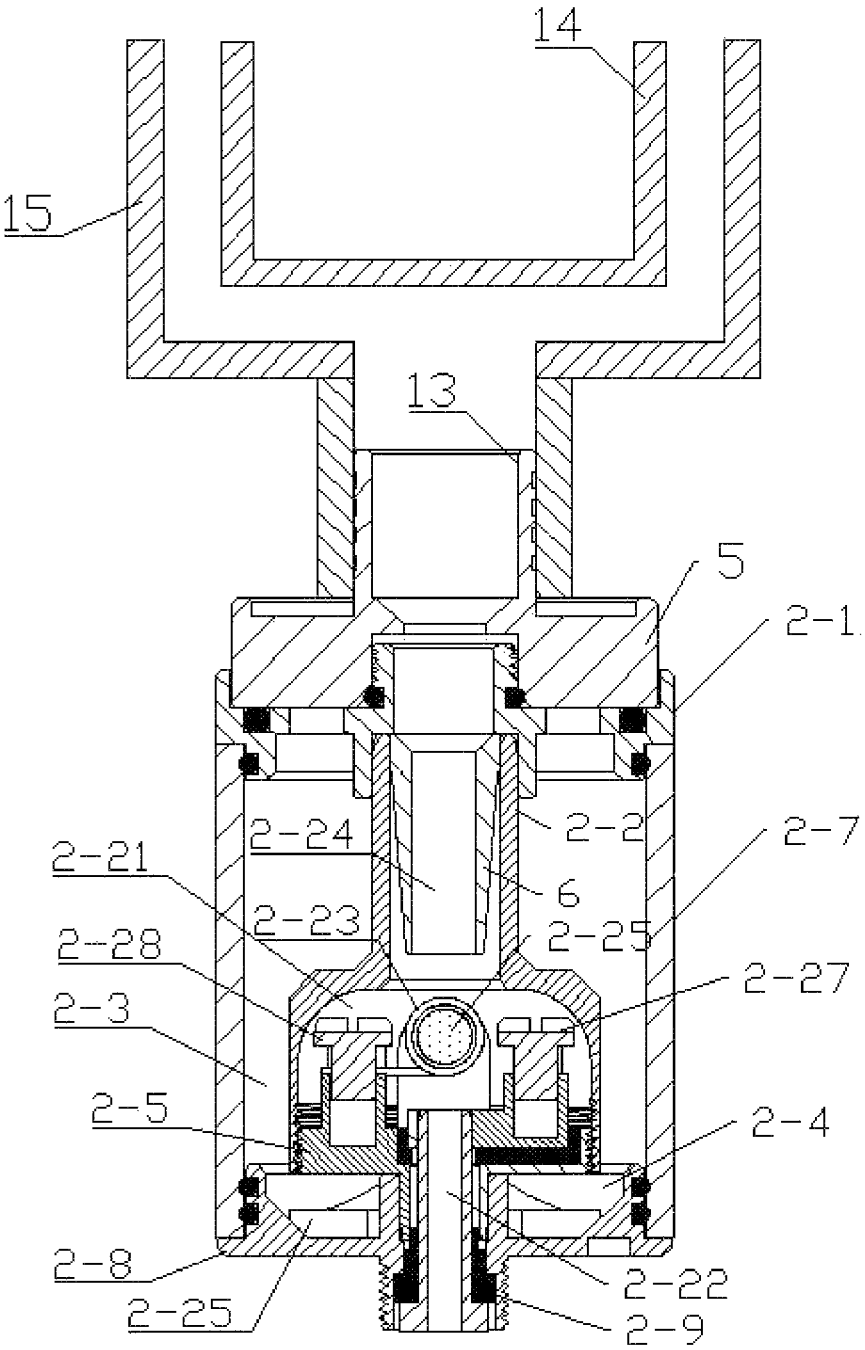
FIG. 11 shows a cross-sectional structural diagram of an atomizing member main body according to embodiment 2 of the present invention.
Figure 12:
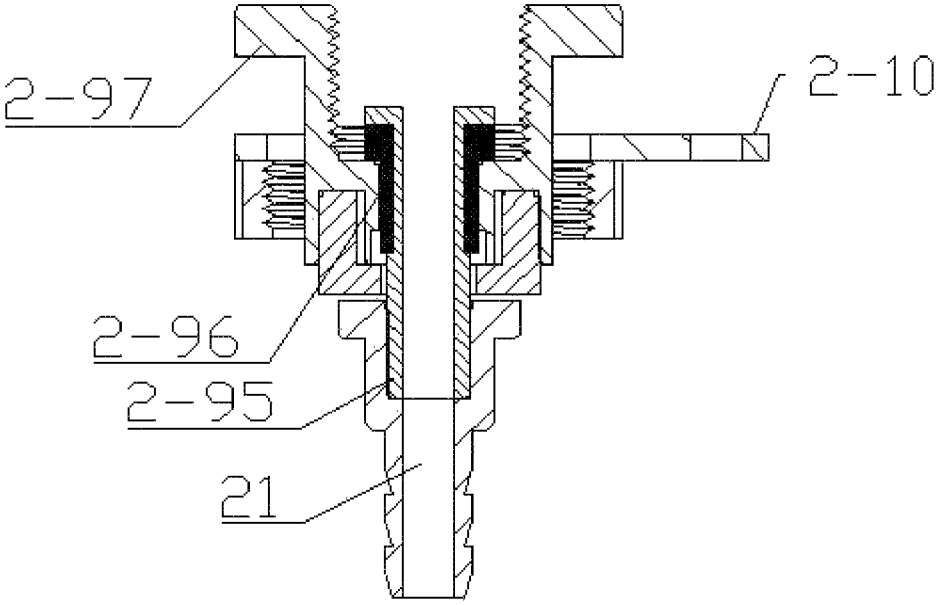
FIG. 12 shows a cross-sectional structural diagram of a fixed joint according to embodiment 2 of the present invention.

In actual application, for aerosol particle and air supply control, FIG. 7 shows the aerosol generator further including a top cover 5 and an atomizing outlet nozzle 13, where the top cover 5 and the atomizing outlet nozzle 13 are both arranged on the upper frame 2-1, and the atomizing outlet nozzle 13 is connected with the top cover 5 as a whole (for example, the top cover 5 can be installed on the top of the upper frame 2-1 through a thread, and the atomizing outlet nozzle 13 is located on the top cover 5). A through hole in the atomizing outlet nozzle 13 is connected with the atomizing outlet hole 4. When the atomizing agent is run out, the top cover 5 can be detached to facilitate users to supplement the atomizing agent into the liquid storage chamber 3. Furthermore, in order to supplement the atomizing agent more conveniently, a liquid supplement tube can be provided on the top cover (the liquid supplement tube is not shown in the figure), through which the atomizing agent can be continuously added to the liquid storage chamber 3. As shown in FIG. 11, the aerosol generator further includes an atomizing nozzle 14 or/and an atomizing outlet tube 15, a power control device, and a cooling gas nozzle, where the atomizing outlet nozzle 13 is connected with the atomizing nozzle 14 or/and the atomizing outlet tube 15, which can meet the requirements of different application scenarios. For example, the atomizing nozzle 14 is mainly used in application scenarios such as a stage with a smoke special effect, and the atomizing outlet tube 15 is mainly used to extend the distance between the atomizing device and the atomization outlet. The gas source device can be a gas pump whose air outlet is connected with the air passage 21. The cooling air nozzle is located in the air passage 21. The cooling air nozzle can change the aperture or/and structure of the air passage 21, and the voltage of the gas pump can be adjusted. Therefore, the power of the gas pump can be adjusted indirectly or directly by changing the working voltage of the gas pump, leading to an adjustment of the velocity or/and volume of the cooling gas and control of the heat dissipation power during the aerosol generation process. The velocity or/and volume of the local cooling air can be further adjusted by changing the aperture and structure of the air passage through the cooling air nozzle according to different heat dissipation requirements. The power control device is connected to the power supply, the power control device can regulate and control the working voltage of the atomizing wire 2-23, and then the heating power can be regulated by changing the working voltage and the power supply duty ratio of the atomizing wire 2-23, so as to adjust the atomizing temperature and the atomizing particle size of the aerosol precisely. After the atomizing agent forms an aerosol, the particle size and the concentration of the aerosol can be adjusted by controlling the viscosity of the cooling gas, and the temperature of the aerosol can be adjusted by controlling the heating power of the atomizing wire 2-23, the heat dissipation power of the cooling gas and the viscosity of the atomizing agent. For example, after the aerosol is formed from the atomizing agent, the temperature of the aerosol can be adjusted by controlling the heating power of the atomizing wire 2-23, the heat dissipation power of the cooling gas, and the viscosity of the atomizing agent. Specifically, the voltage in the circuit can be regulated through variable resistance, PMW, PLD, etc., to achieve a quantitative control of the heating power of the atomizing wire 2-23. The power of the gas source device 12 (e.g., gas pump), the pressure of the compressed gas, or the structure of the air passage 21 can be regulated to achieve a quantitative control of the volume, velocity, and pressure of the cooling gas directly or indirectly, thus controlling the heat dissipation power of the cooling gas. In the atomization process, a boiling point temperature of the atomizing agent in the range of 50-300° C. can be accurately controlled by adjusting the heating power of the atomizing wire 2-23 and the heat dissipation power of the cooling gas. In addition, it is also possible to adjust the viscosity of the atomizing agent, as well as the liquid-storage and liquid-guiding materials to improve the dynamic atomization volume of the atomizing agent, which further stabilize the atomization temperature. Through the correlation parameters of the atomizing temperature and the resistivity of the atomizing wire where the resistivity of the atomizing wire is monitored and collected and the temperature parameters are used as feedback elements when the atomizing wire is heated, and PLD adjustment or general adjustment of the heating power and heat dissipation power, the atomizing temperature or feedback of the oil supply can be control accurately.

According to the actual needs of the user, the aerosol generator is provided with a gas-electric extension cable 16, where one end of the gas-electric extension cable 16 is connected to the fixed joint 2-8, and the other end of the gas-electric extension cable 16 is connected to the movable joint 2-9. The cooling gas is sent to the atomizing chamber 2-21 through the air passage 21, the gas-electric extension cable 16, the gas-electric hybrid junction 9, and the cooling channel 2-22 in sequence. The atomizing wire 2-23 is connected to the power supply via the movable joint 2-9, the gas-electric extension cable 16, and the fixed joint 2-8. The gas-electric extension cable 16 can meet the actual needs of users for convenience or specific application scenarios. For example, for the performance scenes such as magic shows, the atomizing device has a relatively large size, and the use of which will be limited when it is necessary to hide the atomizing device in performance costumes or props. The gas-electric extension cable 16 can be used in this case to independently lead out the modular atomizing device, to realize split atomization, and although the distance between the atomizing device in the modular aerosol generator and the gas source device 12 is relatively long, the aerosol generator equipped with the gas-electric extension cable 16 can meet the actual needs of the performance scene, due to one end of the gas-electric extension cable 16 is connected to the fixed joint 2-8, and the other end of the gas-electric extension cable 16 is connected to the movable joint 2-9. The gas-electric extension cable 16 generally includes two or more wires 16-1, an inlet tube 16-2, and an outlet tube 16-3, where the atomizing wire 2-23 is connected to the power supply through the movable joint 2-9, the two or more wires 16-1, and the fixed joint 2-8 in sequence. The insides of the inlet tube 16-2 and the outlet tube 16-3 are both provided with vent holes 16-4, and the vent holes 16-4 are connected to the air passage 21. The inlet tube 16-2 is connected to the fixed joint 2-8, and the outlet tube 16-3 is connected to the movable joint 2-9. When the aerosol generator is provided with multiple atomizing devices, the linkage work of multiple modular aerosol generators can be achieved by using a one-to-many gas-electric extension cable 16 in the smoke-demanding scene, where the gas-electric extension cable 16 is designed with an inlet tube 16-2 and multiple outlet tubes 16-3, the gas-electric hybrid junction 9 is designed with a fixed joint 2-8 and multiple movable joints 2-9, where the fixed joint 2-8 is connected to the inlet tube 16-2, the multiple outlet tubes 16-3 are connected to the inlet tube 16-2, and each outlet tube 16-3 is connected to a corresponding atomizing device. When the aerosol generator is provided with multiple gas source devices, the gas-electric extension cable 16 is designed with multiple inlet tubes 16-2 and an outlet tube 16-3, the gas-electric hybrid junction 9 is designed with multiple fixed joints 2-8 and a movable joint 2-9, where each of the gas source devices is connected to a corresponding fixed joint 2-8, each of the fixed joints 2-8 is then connected to a corresponding inlet tube 16-2, the multiple inlet tubes 16-2 are connected to the outlet tube 16-3, and the outlet tube 16-3 is connected to the movable joint 2-9.

The advantages of the present invention are as follows: the modular aerosol generator includes the upper frame 2-1, the liquid storage chamber 2-3, the cooling gas, the atomizing member 2-2, and the lower frame 2-8, where the atomizing member 2-2 is installed in the liquid storage chamber 2-3, the atomizing member 2-2 and the liquid storage chamber 2-3 are hermetically fixed between the upper frame 2-1 and the lower frame 2-8, which prevents the atomizing agent from leaking out of the liquid storage chamber 2-3. In order to ensure that the aerosol generator can provide oil continuously and prevent leakage in different working postures, for example, in upright posture, tilted posture, flat posture, and the like, a top of the lower frame 2-8 is provided with the liquid-guiding chamber 2-4, where the liquid-guiding chamber 2-4 is connected with the liquid storage chamber 2-3, and the installing seat 2-5 is arranged at the bottom of the atomizing chamber 2-21. The oil-guiding hole, the positive connector 2-27, and the negative connector 2-28 are located on the installing seat 2-5, where one end of the atomizing wire 2-23 is connected to the positive base 2-93 through the positive connector 2-27, the other end of the atomizing wire 2-23 is connected to the negative fixing head 2-94 through the negative connector 2-28. The middle of the oil-guiding member 2-25 is fixed in the atomizing wire 2-23, and the two ends of the oil-guiding member 2-25 pass through the oil-guiding holes respectively and fill the bottom of the liquid-guiding chamber 2-4. The installing seat 2-5 is hermetically connected with the inner side of the atomizing member 2-2, therefore, the liquid storage chamber 2-3 and the atomizing chamber 2-21 are two independent spaces, and the atomizing agent can only penetrate to the atomizing chamber 2-21 through the oil-guiding member 2-25 for heating and vaporization. The atomizing agent in the liquid storage chamber 2-3 can not enter the atomizing chamber 2-21 with a low liquid level directly under the action of external atmospheric pressure and internal negative pressure, and the atomizing agent in the liquid-guiding chamber 6 can only be transferred to the atomizing wire 2-23 in the atomizing chamber 2-21 based on the capillary action of the oil-guiding member 2-25 for heating and atomization. The "big top and small bottom" structure of the liquid-guiding chamber 2-4 can further ensure that the oil-guiding member 2-25 is fully infiltrated in the atomizing agent and not affected by the working posture. When the aerosol generator is inverted, the atomizing agent in the liquid storage chamber 2-3 is separated from the liquid-guiding chamber 2-4, and the oil-guiding member 2-25 absorbs the residual atomizing agent, thereby preventing the atomizing agent from leakage.

The atomizing member 2-2 includes the atomizing chamber 2-21 located at the lower part of the atomizing member 2-2, the cooling channel 2-22 located at the bottom of the atomizing chamber 2-21, the atomizing outlet channel 2-24 located at the top of the atomizing chamber 2-21, the atomizing wire 2-23, and the oil-guiding member 2-25, where the atomizing agent in the liquid storage chamber 3 penetrates to the atomizing wire 2-23 through the oil-guiding member 2-25 for heating and vaporization, and the cooling gas is fed into the atomizing chamber 2-21 through the cooling channel 2-22. The atomizing wire 2-23 is located in the atomizing chamber 2-21 and fixed at the entrance of the atomizing outlet channel 2-24, and the cooling channel 2-22 is located at the bottom of the atomizing chamber 2-21. Therefore, when the atomizing agent is heated by the atomizing wire 2-23 and is in a steam state, the cooling gas flowing from the cooling channel 2-22 located at the bottom of the atomizing chamber 2-21 to the atomizing chamber 2-21 can perform a sudden cooling on the atomizing agent heated to supersaturated state on the surface of the atomizing wire 2-23 to form the aerosol quickly. Then the formed aerosol is blown out of the aerosol generator. As a result, the aerosol with a good atomization effect is formed from the atomizing agent through the "liquid-gas-liquid" physical change in the aerosol generator. The atomization process is implemented in the atomizing device which avoids the external atmospheric environment limitation, and the gas source device 12 and the atomizing outlet are both pressurized, however, the back pressure in the air passage 21 does not affect the aerosol generation process, and the aerosol form can be controlled by adding a flow-stabilizing tube and various speed-increasing or speed-reducing nozzles at the atomizing outlet nozzle 13. Due to that the oil supply is based on the capillary principle, the oil-guiding member 2-25 is made of flexible fiber fabric materials with good temperature resistance or solid material with tiny voids, the atomizing agent in the liquid storage chamber 2-3 can continuously penetrate to the atomizing wire 2-23 under the action of negative pressure and permeation effect, therefore, the "liquid-gas-liquid" atomization process is continuously repeated. With the consumption of the atomizing agent in the liquid storage chamber 2-3, the negative pressure in the liquid storage chamber 2-3 can prevent the aerosol generator from poor atomization effect due to excessive atomizing agent. The liquid storage chamber 2-3 and the atomizing chamber 2-21 are two independent spaces, and the oil-guiding member 2-25 can supply oil to the atomizing wire 2-23 through a liquid-guiding method, therefore, the atomizing wire 2-23 only need to heat the limited atomizing agent on the oil-guiding member 2-25, which effectively reduces the heating load of the atomizing wire 2-23 and realizes instantaneous atomization and low power consumption. The aerosol generator of the present invention can provide aerosol with normal temperature and fine particle size sustainably and instantaneously, can work under the power condition of less than 200 W with no preheating, and can be directly driven by a small-capacity lithium battery to meet the requirements of different scenarios. The cooling gas is generally selected from air, inert gas, and carbon dioxide (other types of gases can also be used). Since the cooling gas is sent into the atomizing chamber 2-21 to quickly cool down the atomizing agent in the high-temperature steam state to form an aerosol with normal temperature and good atomization effect, the risk of burns is prevented and the use safety is ensured for users and other persons. The cooling channel 2-22 is located directly below the atomizing wire 2-23, the atomizing outlet channel 2-24 is located directly above the atomizing wire 2-23, and the top of the atomizing chambers 2-21 on both sides of the atomizing outlet channel 2-24 are designed as arc-shaped, inverted cone-shaped, or cylindrical, so that after the cooling gas is ejected to the atomizing wire 2-23 and the oil-guiding member 2-25 through the cooling channel 2-22, it can directly act on the surface of the atomizing wire 2-23 to cool down the atomizing agent heated to a supersaturated state to form an aerosol. Under the barrier of the atomizing wire 2-23 and the oil-guiding member 2-25, the mixed gas of the aerosol steam and the atomizing agent droplets is split and sprayed to the side wall of the atomizing chamber 2-21. Then the aerosol steam is ejected from the side walls to the atomizing outlet channel 2-24, and the condensed atomizing agent droplets with larger particle size and not atomized sufficiently flow back up or down along the side walls to the oil-guiding member 2-25 for reheating and revaporization. A few condensed liquid moving upward can return to the atomizing chamber 2-21 for reheating and revaporization under the effect of the outlet return element 2-6 located in the atomizing outlet channel 2-24, which effectively inhibits the occurrence of oil ejection.

The aerosol generator of the present invention adopts the gas-electric hybrid junction with the air passage 21 arranged inside, the cooling gas can be fed into the atomizing chamber 2-21 through the air passage 21 and the cooling channel 2-22, and the atomizing wire 2-23 can be connected with the power supply through the atomizing member 2-2 and the gas-electric hybrid junction. Since the entire atomizing member 2-2 is installed in the liquid storage chamber 2-3, and the voltage and pressure of the aerosol generator can be supplied independently, the aerosol generator has a compact structure and small size. And the volume of the aerosol generator can be further greatly reduced to realize hand-held or split-type application and convenient carry because of the compact structure and low power consumption of the aerosol generator. The gas-electric hybrid junction 9 includes the fixed joint 2-8 and the movable joint 2-9, where the fixed joint 2-8 is installed on the driver main body of the aerosol generator or the led out-split mounting seat, and the atomizing device and the movable joint 2-9 are assembled to form the atomizing main body. The atomizing main body is used as a modular component with the movable joint 2-9 arranged on. Therefore, a thread, a buckle, an external force pressing, or a magnetic attraction can be utilized to realize the connection and separation of the fixed joint 2-8 and the movable interface 2-9. When the aerosol generator is in the working state, the movable joint 2-9 needs to be connected with the fixed joint 2-8, which connects the atomizing main body with the driver main body, connects the atomizing wire 2-23 with the power supply, and connects the cooling channel 2-22 with the gas source device 12, thus making the product a highly compact structure and miniaturizing and modularizing the aerosol generator. Because of the atomizing main body assembled from the atomizing device and the movable joint 2-9, the circuit of the atomizing main body connects the gas path reliably through the gas-electric hybrid junction, and the atomizing main body and the gas-electric hybrid junction can be easily installed and detached, so that the atomizing main body as an independent module can generate the aerosol with only providing the cooling gas and voltage required for the operation, which miniaturizes the aerosol generator and greatly expands the product use scenes. Atomizing elements in the aerosol generator of the present invention, such as liquid storage, aerosol generation, energy supply, and fixation, have been modularized, which can be quickly installed and detached through the gas-electric hybrid junction, so that the atomizing main body can be regarded as a standard part or consumable part which can be maintained and replaced as a standard atomization module with interchangeability according to the design life and actual needs. And the standard atomizing module can be produced on a large scale and reused, therefore, the cost of use can be greatly reduced.

The power of the gas pump can be adjusted indirectly by changing the working voltage of the gas pump in the aerosol generator of the present invention, leading to an adjustment of the velocity or/and volume of the cooling gas and control of the heat dissipation power during the aerosol generation process. The velocity or/and volume of the local cooling air can be further adjusted by changing the aperture and structure of the air passage 21 through the cooling air nozzle according to different heat dissipation requirements. The heating power can be regulated by changing the working voltage and the power supply duty ratio of the atomizing wire 2-23 to adjust the atomizing temperature and the atomizing particle size of the aerosol precisely, thus meeting the high requirement of atomizing temperature and the atomizing particle size in medicine, agriculture, and disinfection and sterilization.

The above are only specific embodiments of the present invention, and the protection scope of the present invention is not limited thereto. Any change or replacement that can be easily thought of by those skilled in the art according to the disclosure in the present invention should be covered within the protection scope of the present invention. Therefore, the protection scope of the present invention should be subject to the appended claims.

What is claimed is:

1. An aerosol generator, comprising:

an atomizing device, wherein the aerosol generator further comprises a gas-electric hybrid junction and a gas source device, wherein the atomizing device is provided with an air passage located at the bottom of the atomizing device, the atomizing device is connected to a power supply through the gas-electric hybrid junction, and the gas source device is in communication with the air passage through the gas-electric hybrid junction and provides a cooling gas.

2. The aerosol generator according to claim 1, wherein the atomizing device comprises an upper frame, a liquid storage chamber, an atomizing member, and a lower frame, wherein the atomizing member is installed in the liquid storage chamber, the atomizing member and the liquid storage chamber are hermetically fixed between the upper frame and the lower frame;

the atomizing member comprises an atomizing chamber, an atomizing wire, and an oil-guiding member that are located at a lower part of the atomizing member; and the air passage comprises a cooling channel located at the bottom of the atomizing chamber and an atomizing outlet channel located at the top of the atomizing chamber, wherein the atomizing wire is located in the atomizing chamber and is fixed at an entrance of the atomizing outlet channel;

an atomizing agent in the liquid storage chamber penetrates to the atomizing wire through the oil-guiding member for heating and vaporization, and the cooling gas is fed into the atomizing chamber through the cooling channel.

3. The aerosol generator according to claim 2, wherein a liquid-guiding chamber is arranged at a top of the lower frame, and the liquid-guiding chamber is in communication with the liquid storage chamber and is located at the bottom of the liquid storage chamber, and a top of the cooling channel is higher than a top of the liquid-guiding chamber.

4. The aerosol generator according to claim 3, wherein an outside surface at a bottom of the liquid-guiding chamber is inverted cone-shaped or arc inclined plane-shaped, the atomizing wire is made of metal with good heat resistance, a resistance value of the atomizing wire is in a range of 0.05-25 ohms, and a middle part of the oil-guiding member is fixed in the atomizing wire, and two ends of the oil-guiding member fill the bottom of the liquid-guiding chamber.

5. The aerosol generator according to claim 2, wherein the atomizing wire is in a shape of a spiral, a tube, a mesh, or a sheet, and the oil-guiding member is made of a flexible fiber fabric material with good temperature resistance or a solid material with tiny voids.

6. The aerosol generator according to claim 2, wherein a mounting hole is arranged in the middle of the lower frame, the gas-electric hybrid junction passes through the mounting hole and is hermetically connected to the lower frame, and the atomizing wire is connected to the power supply through the gas-electric hybrid junction.

7. The aerosol generator according to claim 2, wherein an air passage is also arranged inside the gas-electric hybrid junction, and the cooling gas is fed into the cooling channel through the gas-electric hybrid junction;

the gas-electric hybrid junction comprises a fixed joint and a movable joint, wherein the movable joint is connected to the fixed joint, and the fixed joint and the movable joint are used to turn on or off positive and negative electrodes of the power supply and a gas source of the cooling gas.

8. The aerosol generator according to claim 7, wherein the movable joint is connected to the fixed joint employing a thread, a buckle, an external force pressing, or a magnetic suction, the atomizing wire is located directly below the atomizing outlet channel, the cooling channel is located directly below the atomizing wire, and a top of the atomizing chamber on both sides of the atomizing outlet channel is designed to be arc-shaped, inverted cone-shaped, or cylindrical.

9. The aerosol generator according to claim 7, wherein the movable joint comprises a first insulating ring, a positive base, and a negative fixing head, wherein the positive base is fixed in a mounting hole in the lower frame, and the first insulating ring is located between the negative fixing head and the positive base; and a positive end of the atomizing wire is connected with the positive base, and a negative end of the atomizing wire is connected with the negative fixing head;

the fixing joint comprises a second insulating ring, a positive connecting seat, and a negative connecting head, wherein the second insulating ring is located between the positive connecting seat and the negative connecting head;

when the fixed joint is connected with the movable joint, the air passage is in communication with the cooling channel, the atomizing wire is connected with the power supply through the movable joint and the fixed joint in sequence, the negative fixing head is arranged on the lower frame, the lower frame is fixed on the negative connecting head by a thread, a buckle, an external force pressing, or a magnetic suction, and the positive base is tightly attached to the positive connecting seat.

10. The aerosol generator according to claim 9, wherein the aerosol generator further comprises an installing seat installed at the bottom of the atomizing chamber and connected with an inner side of the atomizing member;

the installing seat is provided with an oil-guiding hole, a positive connector, and a negative connector, wherein one end of the atomizing wire is connected with the positive base through the positive connector, and the other end of the atomizing wire is connected with the negative fixing head through the negative connector.

11. The aerosol generator according to claim 7, wherein the aerosol generator further comprises a gas-electric extension cable, wherein one end of the gas-electric extension cable is connected to the fixed joint, and the other end of the gas-electric extension cable is connected to the movable joint;

the cooling gas is fed into the atomizing chamber through the air passage, the gas-electric extension cable, the gas-electric hybrid junction, and the cooling channel in sequence, and the atomizing wire is connected to the power supply through the movable joint, the gas-electric extension cable, and the fixed joint in sequence.

12. The aerosol generator according to claim 11, wherein the gas-electric extension cable comprises two or more wires, one or more inlet tubes, and one or more outlet tubes, wherein the atomizing wire is connected to the power supply through the movable joint, the two or more wires, and the fixed joint in sequence;

the insides of the inlet tube and the outlet tube are both provided with vent holes, wherein the vent holes are in communication with the air passage, the inlet tube is connected with the fixed joint, and the outlet tube is connected to the movable joint.

13. The aerosol generator according to claim 12, wherein the aerosol generator is provided with a plurality of the atomizing devices, the gas-electric extension cable is provided with one inlet tube and a plurality of outlet tubes, and the gas-electric hybrid junction is provided with one fixed joint and a plurality of movable joints, wherein the fixed joint is connected to the inlet tube, the plurality of outlet tubes are connected to the inlet tube, and each outlet tube is connected to a corresponding atomizing device.

14. The aerosol generator according to claim 11, wherein the cooling gas is selected from air, inert gas, and carbon dioxide, a pressure of the cooling gas is in a range of 0.002-0.7 MPa, a resistance value of two wires is 1-200 ohm/km, and a diameter of the wires is 0.2-10 mm.

15. The aerosol generator according to claim 2, wherein the aerosol generator further comprises an outlet return element, the outlet return element is located in the atomizing outlet channel.

16. The aerosol generator according to claim 2, wherein the aerosol generator further comprises a top cover, the top cover is arranged on the upper frame.

17. The aerosol generator according to claim 16, wherein the aerosol generator further comprises an atomizing outlet nozzle arranged on the upper frame, and the atomizing outlet nozzle and the top cover are connected as a whole.

18. The aerosol generator according to claim 17, wherein the aerosol generator further comprises an atomizing nozzle or/and an atomizing outlet tube, the atomizing nozzle or/and the atomizing outlet tube is connected with the atomizing outlet nozzle.

19. The aerosol generator according to claim 2, wherein the aerosol generator is provided with a power control device connected to the power supply, wherein the power control device is used to regulate an operating voltage of the atomizing wire.

20. The aerosol generator according to claim 2, wherein after the atomizing agent forms an aerosol, a particle size and a concentration of the aerosol are adjusted by controlling a velocity of the cooling gas, and a temperature of the aerosol is adjusted by controlling a heating power of the atomizing wire, a heat dissipation power of the cooling gas, and a viscosity of the atomizing agent.

21. The aerosol generator according to claim 1, wherein the aerosol generator further comprises a cooling gas nozzle, the cooling gas nozzle is located in the air passage and is capable of changing the aperture or/and structure of the air passage.

22. The aerosol generator according to claim 1, wherein the atomizing device comprises a atomizing member, an upper frame, a liquid storage chamber, and a lower frame, wherein the atomizing member is located in the liquid storage chamber, the atomizing member and the liquid storage chamber are hermetically fixed between the upper frame and the lower frame, the air passage and a heating member are arranged in the atomizing member, and a liquid-guiding hole is set on a side of the atomizing member, wherein the heating member is located around the air passage, an atomizing agent in the liquid storage chamber penetrates to the heating member through the liquid-guiding hole for heating and vaporization, the upper frame is provided with an atomizing outlet hole, wherein the gas-electric hybrid junction and the atomizing outlet hole are respectively connected with the air passage, and the gas source device sends the cooling gas to the air passage through the gas-electric hybrid junction.

23. The aerosol generator according to claim 22, wherein the aerosol generator further comprises an outlet return element, an atomizing outlet nozzle, an atomizing nozzle or/and an atomizing outlet tube, wherein the atomizing outlet nozzle is fixed on the upper frame, the outlet return element is located in the air passage, the atomizing outlet nozzle is connected with the atomizing nozzle or/and the atomizing outlet tube;

the atomizing member further comprises an atomizing core and a rack, wherein two ends of the rack are hermetically connected with the upper frame and the lower frame respectively, the air passage is located in the rack, the atomizing core is fixed under the rack, the heating member is fixed in the atomizing core, and the liquid-guiding hole is located outside the atomizing core; the atomizing device is further provided with a shell hermetically connected with the upper frame and the lower frame respectively, wherein the liquid storage chamber is formed by the surround of an inner wall of the shell and outer walls of the upper frame, the lower frame, and the rack.

24. The aerosol generator according to claim 23, wherein the aerosol generator further comprises a gas tube, an air passage is also provided in the middle of the gas-electric hybrid junction, wherein one end of the gas tube is connected to the gas source device, and the other end of the gas tube is in communication with the air passage; the heating member is connected to the power supply through the gas-electric hybrid junction;

a mounting hole is arranged in the middle of the lower frame made of a conductive material;

the gas-electric hybrid junction comprises a fixed joint and a movable joint, wherein the fixed joint comprises a first insulating ring, a positive base, and a negative fixing head, the positive base is fixed in the mounting hole, a lower end of the rack is fixed on the positive base, and the first insulating ring is located between the negative fixing head and the positive base;

the positive electrode of the heating member is tightly attached to the positive base through an outer side of the first insulating ring, and the negative electrode of the heating member is tightly attached to the negative fixing head through an inner side of the first insulating ring;

the movable joint comprises a second insulating ring, a positive connecting seat, and a negative connecting head, wherein the second insulating ring is located between the positive connecting seat and the negative connecting head;

when the fixed joint is connected with the movable joint, the positive connecting seat is fixed below the lower frame, and the negative connecting head is tightly attached to the negative fixing head.

25. The aerosol generator according to claim 24, wherein an aperture size of the air passage at the connection of the negative fixing head and the atomizing core is smaller than an aperture size of the air passage in the atomizing core, so that a pressure of the air passage in the atomizing core is smaller than a pressure in the liquid storage chamber.

26. The aerosol generator according to claim 24, wherein the aerosol generator further comprises a gas-electric extension cable, wherein one end of the gas-electric extension cable is connected to the fixed joint, and the other end of the gas-electric extension cable is connected to the movable joint, the cooling gas is fed into the atomizing core through the air passage, the fixed joint, the gas-electric extension cable, and the movable joint in sequence, and the heating member is connected to the power supply through the movable joint, the gas-electric extension cable, and the fixed joint in sequence.

27. The aerosol generator according to claim 22, wherein a power of the atomizing device is in a range of 5-200 W, the cooling gas is selected from air, inert gas, and carbon dioxide, a pressure of the cooling gas provided by the gas source device is in a range of 0.002-0.7 MPa;

after the atomizing agent forms an aerosol, a particle size and a concentration of the aerosol are adjusted by controlling a velocity of the cooling gas, and a temperature of the aerosol is adjusted by controlling a heating power of the atomizing wire, a heat dissipation power of the cooling gas, and a viscosity of the atomizing agent.

28. The aerosol generator according to claim 1, wherein the gas source device comprises a gas pump, an outlet of the gas pump is in communication with the air passage, and a voltage of the gas pump is adjustable.

* * * * *